US005690350A

United States Patent [19]

Turner et al.

[11] Patent Number: 5,690,350

[45] Date of Patent: Nov. 25, 1997

[54] SNOWBOARD BINDING

[75] Inventors: Brent H. Turner; John E. Svensson, both of Seattle, Wash.

[73] Assignee: K-2 Corporation, Vashon, Wash.

[21] Appl. No.: 628,054

[22] Filed: Apr. 8, 1996

Related U.S. Application Data

[63] Continuation of Ser. No. 274,292, Jul. 12, 1994, Pat. No. 5,505,477, which is a continuation-in-part of Ser. No. 127,584, Sep. 27, 1993, Ser. No. 120,629, Sep. 13, 1993, Pat. No. 5,452,907, Ser. No. 100,745, Aug. 2, 1993, abandoned, and Ser. No. 94,576, Jul. 19, 1993, Pat. No. 5,437,466.

[51] Int. Cl.[6] ..... A63C 9/08

[52] U.S. Cl. ..... 280/613; 280/617; 280/14.2

[58] Field of Search ..... 280/14.2, 613, 280/616, 617, 607, 618, 625; 36/117.1, 117.3

[56] References Cited

U.S. PATENT DOCUMENTS

| | | | |
|---|---|---|---|
| D. 325,663 | 4/1992 | Barret et al. . | |
| D. 327,360 | 6/1992 | Graham . | |
| 1,546,551 | 7/1925 | Petri . | |
| 2,693,967 | 11/1954 | Jones, Jr. . | |
| 3,061,325 | 10/1962 | Glass . | |
| 3,775,866 | 12/1973 | Marker . | |
| 3,900,204 | 8/1975 | Weber . | |
| 3,931,980 | 1/1976 | Marker | 280/613 |

(List continued on next page.)

FOREIGN PATENT DOCUMENTS

| | | |
|---|---|---|
| 30 04 668 | 8/1981 | Germany . |
| 88 07 537 | 9/1988 | Germany . |
| 42 19 036 A1 | 1/1993 | Germany . |

*Primary Examiner*—Brain L. Johnson
*Assistant Examiner*—Michael Mar
*Attorney, Agent, or Firm*—Christensen O'Connor Johnson and Kindness PLLC

[57] ABSTRACT

A boot for use with a snowboard having a binding for attachment to the boot. The boot includes a base, a highback, and an upper. The base includes a binding-receiving plate for attaching the boot to the binding on the snowboard. The base also has toe and heel ends. The base is formed with a toecap at the toe end and has a heel counter at the heel end. Tread projects from the bottom of the base for traction when the boot is not attached to the snowboard. The highback extends upwardly from the heel counter of the base. The highback provides aft support to the user. The upper is fixedly attached to the base and is arranged and configured to receive the foot and ankle of the user. The upper has a rearward side adjacent the highback. The upper is more flexible than the base and the highback. A base strap is connected to opposing sides of the base and extends across a portion of the upper. The binding includes a frame for attachment to the snowboard, a first coupling to secure the forward end of the boot, and a second coupling to secure the rearward end of the boot. The couplings are releasable with arms that extend from the sides of the frame. The coupling that secure the forward end of the boot may include either a set of jaws or a simple hook. Both sets of couplings hold the boot, within the sole of the boot, along an axis near the longitudinal center axis of the sole of the boot.

19 Claims, 23 Drawing Sheets

U.S. PATENT DOCUMENTS 3,955,825 5/1976 Kubelka et al. .
4,021,056 5/1977 Oakes .
4,177,584 12/1979 Beyl .
4,185,851 1/1980 Salomon .
4,191,395 3/1980 Salomon .
4,290,213 9/1981 Salomon .
4,316,618 2/1982 Sampson .
4,334,367 6/1982 Salomon .
4,361,344 11/1982 Hull et al. .
4,395,055 7/1983 Spademan .
4,403,789 9/1983 Hickey .
4,454,663 6/1984 Graillat et al. .
4,653,203 3/1987 De Mattheis .
4,728,115 3/1988 Pozzobon et al. .
4,728,116 3/1988 Hill .
4,768,804 9/1988 With .
4,836,572 6/1989 Pozzobon .
4,846,492 7/1989 Bataille .
4,907,355 3/1990 Allen et al. .
4,937,955 7/1990 Bonaventure .
4,969,655 11/1990 Katz .
4,973,073 11/1990 Raines et al. .
4,979,760 12/1990 Derrah .
5,004,262 4/1991 Provence et al. .
5,007,656 4/1991 Girault et al. .
5,028,068 7/1991 Donovan .
5,035,443 7/1991 Kincheloe .
5,044,654 9/1991 Meyer .
5,054,807 10/1991 Fauvet .
5,069,463 12/1991 Baud et al. ..... 280/14.2
5,105,565 4/1992 Barret .
5,125,173 6/1992 Nagano et al. .
5,143,396 9/1992 Shaanan et al. .
5,145,202 9/1992 Miller .
5,156,644 10/1992 Koehler et al. .
5,171,033 12/1992 Olson et al. .
5,177,884 1/1993 Rullier .
5,188,386 2/1993 Schweizer .
5,190,310 3/1993 Haughlin et al. .
5,190,311 3/1993 Carpenter et al. .
5,261,689 11/1993 Carpenter et al. .
5,299,823 4/1994 Glaser .
5,338,053 8/1994 Hauglin .
5,474,322 12/1995 Perkins et al. ..... 280/613
5,505,477 4/1996 Turner et al. .

120
362
22
300
302
158
306
304
318
308
316
320
312

120
362
22
300
158
302
306
304
304
318
308
316
320
312

SNOWBOARD BINDING

This is a continuation of the prior application Ser. No. 08/274,292, filed Jul. 12, 1994, now U.S. Pat. No. 5,505,477 which is a continuation-in-part of U.S. patent applications Ser. Nos. 08/127,584 filed Sep. 27, 1993; 08/120,629 filed Sep. 13, 1993 now U.S. Pat. No. 5,452,907; 08/100,745 filed Aug. 2, 1993 now abandoned; and 08/094,576 filed Jul. 19, 1993 now U.S. Pat. No. 5,437,466 the benefit of the filing dates of which are hereby claimed under 35 U.S.C. § 120.

FIELD OF THE INVENTION

The present invention relates generally to bindings for sports equipment and, more particularly, to sport boots and bindings for releasable attachment to snow boards and the like.

BACKGROUND OF THE INVENTION

Snowboards have been in use for a number of years, and snowboarding has become a popular winter sports activity. A snowboard is controlled by weight transfer and foot movement, both lateral and longitudinal. Precision edge control is especially important in alpine snowboarding activities where carving, rather than sliding, through the snow is desirable. Therefore, small movements of the snowboarder's feet within the boots can have significant effects on the user's control over the snowboard's movement. However, boot flexibility is also important for many recreational and freestyle snowboarding activities. Despite the widespread acknowledgment of the importance of these two desirable factors of edge control and flexibility, snowboard boots generally do not satisfactorily provide both.

To provide control, mountaineering-type boots have been used, especially in Europe. These boots include a molded plastic, stiff outer shell and a soft inner liner. The boots are mounted on the snowboard using mountaineering or plate bindings. Plate bindings are fastened to the board under the fore and aft portions of the sole of the boot and typically provide both heel and toe bails to secure the boot in place, usually without any safety release mechanism. These boots are stiff enough to provide the desired edge control and stability for carving. However, they are too stiff to allow significant lateral flexibility, a key movement in the sport that is essential for freestyle enthusiasts and desirable for all-around snowboarders. As a result, the mountaineering-type boots feel too constraining to many snowboarders.

Freestyle snowboarding requires more flexibility of the ankle of the snowboarder relative to the board than the mountaineering-type boots allow. Even all-around recreational snowboarding requires some boot flexibility. The stiff mountaineering-type boots offer little lateral flexibility and only marginal fore and aft flexibility. Because of the desire for flexibility, most American snowboarders have opted for an insulated snow boot combined with "soft-shell" bindings. These bindings have rigid bases attached to the board, highback shells, straps to wrap around the boot, and buckles to secure the straps in place. The boots, when removed from the bindings, are standard insulated snow boots or slightly modified snow boots. The flexibility gained from the soft boot and relatively soft binding results in less edge control than a mountaineering-type boot and difficult entry and release. The snowboarder may attempt to gain more edge control by tightening his binding straps around his boots. However, such overtightening may seriously sacrifice comfort. A related problem occurs every time the snowboarder reaches flat terrain, the bottom of the hill, or the chairlift. The snowboarder must unbuckle the straps of at least one binding to scoot along skateboard-style by pushing with the released foot. This may be time consuming and cumbersome, since proper securing and tightening of the binding is difficult. Disembarking from the chairlift with only one boot nonreleasably attached to the snowboard is also hazardous, since the leverage of the board on one ankle or knee could easily cause injury in a fall.

Manufacturers' attempts at providing both edge control and flexibility have centered around plate bindings for use with stiff mountaineering-type boots. Plate bindings offer ease of entry and release-no buckles to unsnap or straps to tighten. They may also be made releasable in response to forces placed thereon during use. Plate binding manufacturers have approached the problem of lateral flexibility from several different angles. For example, one type of binding, made by Emery, offers a two-piece plate—one for the heel and the other for the toe. Under each toeplate and heelplate is a half-inch high rubber pad shaped in the form of a rectangle. The rubber pad is supposed to act as a shock absorber and provide side-to-side flex.

Other attempts have used adaptations of Swiss mountaineering bindings. A hard plate is mounted to the board. Two rectangular boxes—at the toe and heel—cradle a spring steel cage. Bails are connected to the cage and act as cantilevers in creating a side-to-side flex. However, such attempts may sacrifice some edge control by making the interface between boot and board too soft in order to achieve the desired lateral flexibility.

In general, the public has not been satisfied with the use of binding plates to solve the flexibility/control dichotomy and the ease of entry and exit problem. Those serious snowboarders who desire to both carve racing turns and "board" freestyle, purchase two boards and two sets of bindings and boots. Those who are simply recreational boarders or cannot afford the two-board luxury, generally settle on one type or the other, and thus sacrifice performance and/or convenience of one type or the other.

The boot of the present invention solves the flexibility/control problem by proceeding in a different direction from past attempts. The invention provides a boot that allows most of the flexibility of the soft shell boot/binding while retaining the advantages of control and ease of entry and release of the mountaineering-type boot/binding arrangement. The invention thus allows greater comfort, convenience, all-around performance, and safety.

SUMMARY OF THE INVENTION

The present invention provides snowboard boots and bindings. The boots are flexible while giving proper support for edge control of the snowboard. The boots are also much easier to use than a typical freestyle boot, as the soft shell binding is not needed, and a step-in binding can be used.

The binding is for securing a boot having a rearward portion and a forward portion to the snowboard. The boot has a forward attachment member beneath the forward portion, and a rearward attachment member beneath the rearward portion. The binding includes a binding frame, a first jaw, a second jaw, and a first release mechanism. The binding frame is configured for attachment to the snowboard. The first jaw is secured to the frame and is arranged and configured to grasp at least one of the forward and rearward attachment members. The second jaw is also secured to the frame in a location spaced from the first jaw for grasping the other of the forward and rearward attachment members. The first release mechanism is coupled to the first jaw and functions to open the first jaw to release the boot from the first jaw.

In one preferred form of the invention, the binding also includes a second release mechanism coupled to the second jaw for opening the second jaw to release the boot. In one embodiment, the first and second release mechanisms are coupled together. This allows the mechanisms to simultaneously open the first and second jaws. One preferred form of the invention may also include, as part of the frame, a binding plate coupled to the first and second jaws. The binding plate has a surface on which at least a portion of the boot rests.

In one preferred embodiment, the second jaw is fixed and does not move relative to the frame during release of the boot. The opening of the first jaw thus allows both the first and the second attachment members to be released from the first and second jaws. Preferably, the first release mechanism comprises a slide member attached to the first jaw and a lever pivotally attached to the slide member. Movement of the lever causes sliding motion of the slide member and movement of the first jaw. A first static jaw is secured to the frame adjacent the first jaw.

The invention may also be summarized as a snowboard binding apparatus including a boot, a frame, a movable jaw, and a jaw movement mechanism. The boot includes a sole having a first attachment member secured near the longitudinal axis thereof. The frame is securable to a snowboard. The movable jaw is attached to the frame and is positioned to engage the first attachment member of the boot. The jaw movement mechanism is also attached to the frame and coupled to the movable jaw. The jaw movement mechanism includes a release arm extending to the side of the frame and to the side of the boot when engaged by the movable jaw.

In one embodiment, the boot sole includes flex pads secured on the sides of the first attachment member. The flex pads are compressible and resilient to allow the boot to pivot about the first attachment member when engaged by the movable jaw. The flex pads are preferably removable and replaceable, such that flex pads of differing durometers may be used.

A second attachment member is secured to the sole of the boot in one embodiment of the invention. A second jaw is also attached to the frame and engageable with the second attachment member. In this same embodiment, the first attachment member is disposed generally beneath a rearward portion of the boot and the second attachment member is disposed generally beneath a forward portion of the boot. The first attachment member is constructed of a first rod extending generally parallel to the longitudinal axis of the sole of the boot. The sole of the boot includes a rearward recess within which this first rod is held above the lowermost portion of the sole.

In one embodiment, the second attachment member comprises a second rod extending generally parallel to the longitudinal axis of the sole of the boot.

In the preferred embodiment of the invention, the second jaw is fixed relative to the frame. The second jaw includes a hook, and the second attachment member is engageable beneath the hook. The second attachment member comprises a second rod extending generally transverse to the longitudinal axis of the sole of the boot. The sole includes a forward recess within which the second rod is held above the lowermost portion of the sole.

A further aspect of the preferred embodiment of the invention is the construction of the boot comprising a forward end, a rearward end, and a highback extending upwardly from the rearward end. The highback provides aft support to the boot. An upper is fixedly attached to the sole or base of the boot. The upper has a rearward side adjacent the highback, and is more flexible than the highback.

The preferred form of the invention may also be summarized as a snowboard binding for securing a snowboard boot having a forward attachment element beneath a forward end of the boot and a rearward attachment element beneath a rearward end of the boot. The binding includes a frame, a forward coupling means, and a rearward coupling means. The frame is securable to the snowboard. The forward coupling means are secured to the frame. The forward coupling means are engageable with the forward attachment element of the boot. The rearward coupling means are also secured to the frame and are engageable with the rearward attachment element of the boot. The rearward coupling means include a release arm extending from the side of the frame such that the arm projects adjacent the side of the boot when the boot is engaged by the rearward coupling means.

The frame includes at least one attachment plate securable to a snowboard in a plurality of angular orientations relative to the longitudinal axis of the snowboard. Such securement is provided by the attachment plate at the attachment plate's inclusion of a curved slot through which screws may extend to secure the frame to the snowboard. The frame also includes two rails projecting upwardly from and formed integral with the attachment plate. The rails are spaced from each other for receiving the sole of the boot between them. The rails have forward ends and rearward ends. A forward bridge is attached between the forward ends of the rails and a rearward bridge is attached between the rearward ends of the rails. The forward bridge secures the forward coupling means and the rearward bridge secures the rearward coupling means. In the preferred embodiment, the rearward coupling means comprise a movable jaw disposed near the center of the rearward bridge. A static jaw is also provided adjacent the movable jaw. The movable jaw is biased in the direction of the static jaw and a release arm is coupled to the movable jaw. The forward coupling means include a hook member attached to the frame near the center of the forward bridge.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
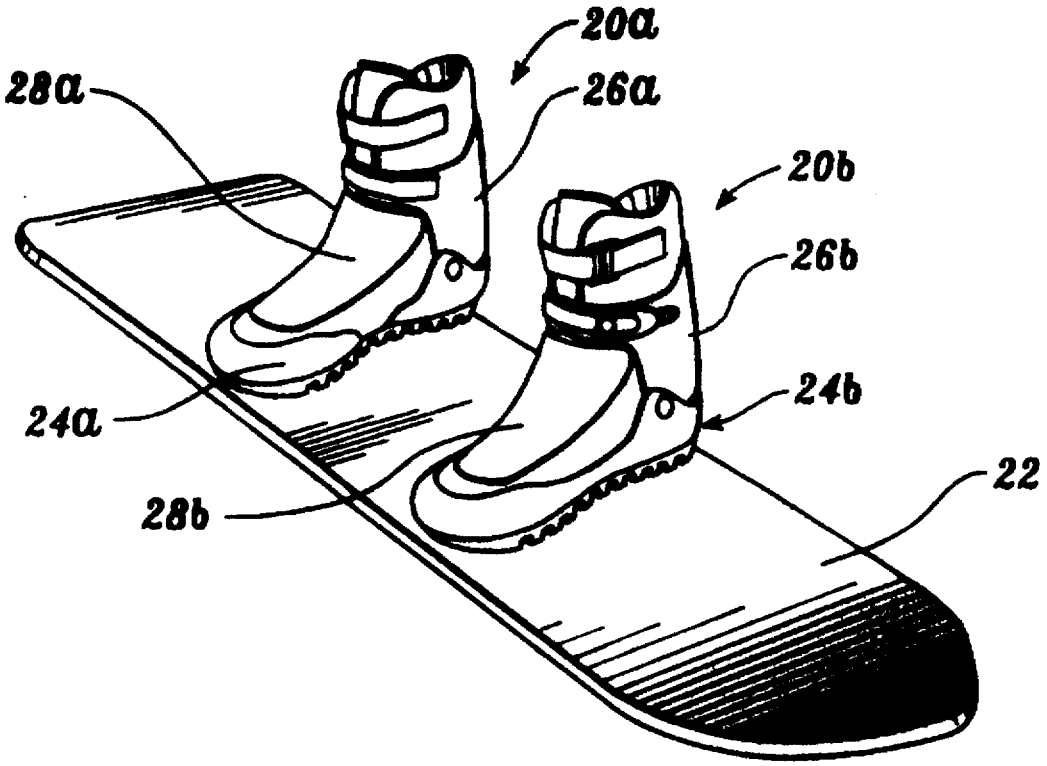
FIG. 1 is a perspective view of one embodiment of the snowboard boots showing the boots attached to a snowboard.

Referring to FIG. 1, boots 20 of the present invention are illustrated in a ready-to-ride position attached to a snowboard 22. Each of boots 20 includes a base 24, a highback 26, and an upper 28. The foot of the user is cupped by base 24. Highback 26 is pivotally connected to base 24 and extends behind and partially on the sides of upper 28. Upper 28 is fixedly secured to base 28. Thus, snowboard boots 20 are provided that combine a soft upper with the support of a soft shell binding built right into the boot itself. With this arrangement, the user can conveniently use standard step-in bindings or other specialized step-in bindings discussed below.

Figure 2:
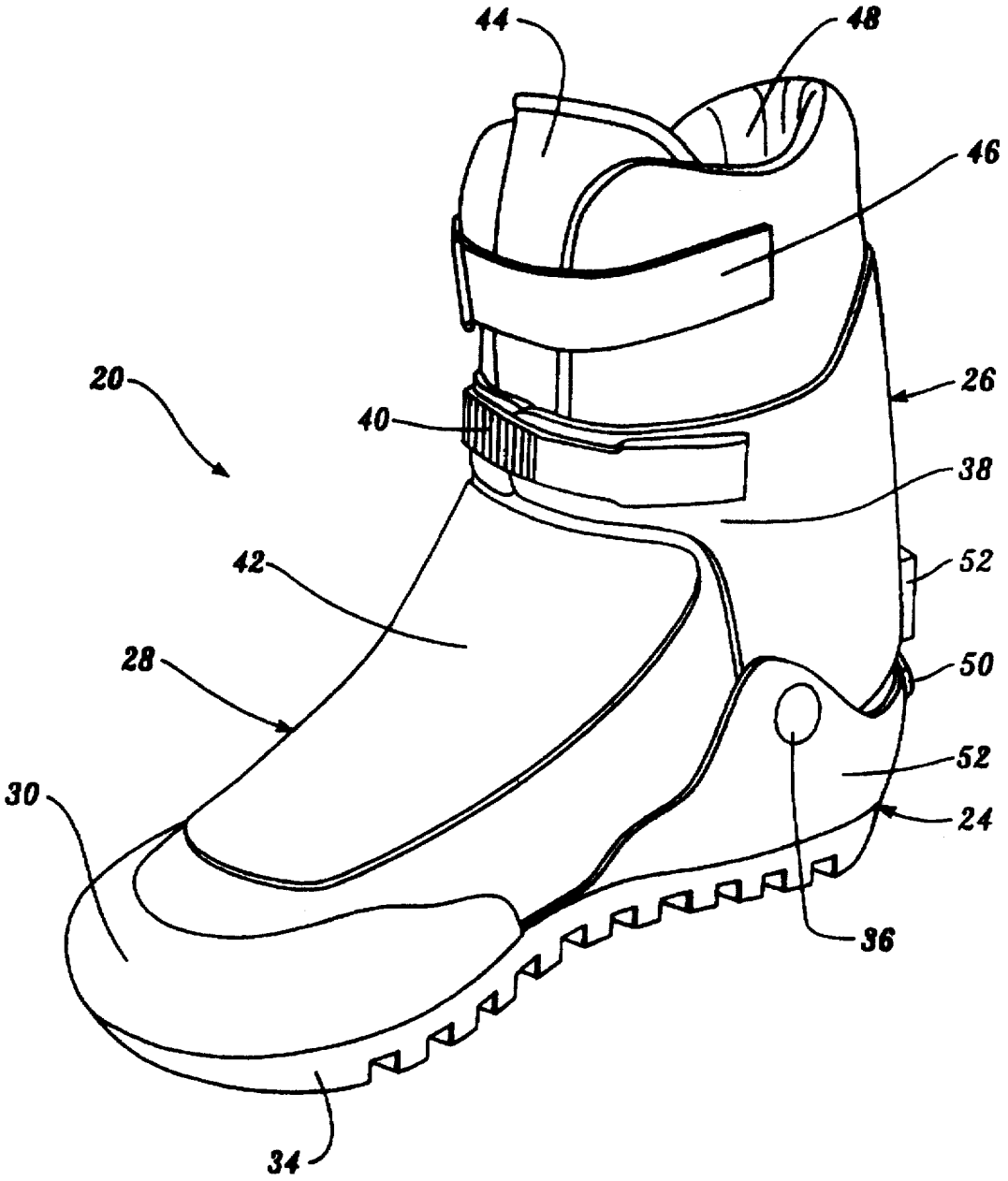
FIG. 2 is a perspective view of the right boot illustrated in FIG. 1.
Figure 3:
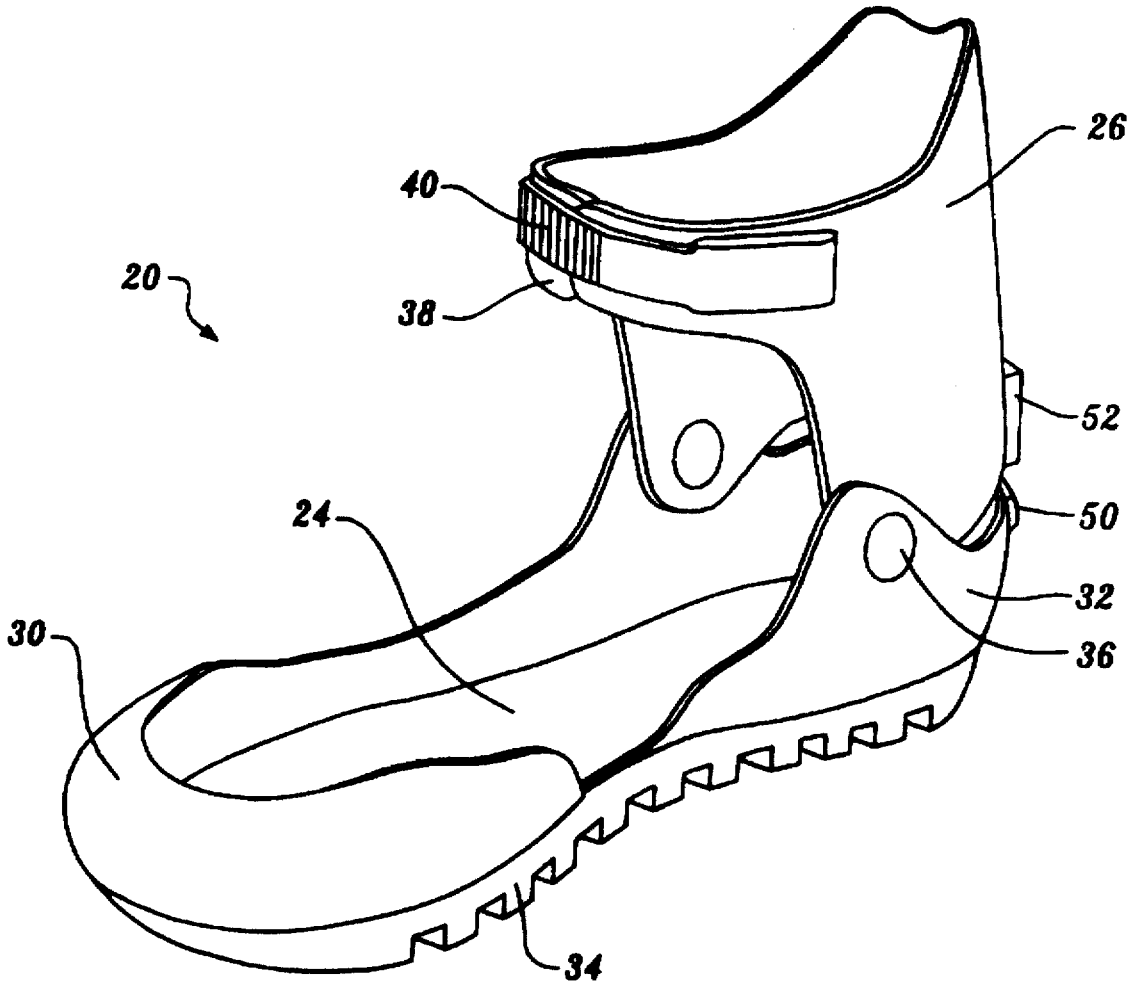
FIG. 3 is a perspective view of the base and the highback of the boot illustrated in FIG. 2.

Referring to FIGS. 2 and 3, the details of boot 20 will be discussed in more detail. Base 24 is preferably constructed of a semirigid material that allows some flex and is resilient. Base 24, for example, may have a base construction similar to the sole construction of either hiking or mountaineering boots. Base 24 includes a toecap 30, a heel counter 32, and tread 34. Toecap 30 is preferably an integrally formed portion of base 24. Toecap 30 surrounds the toe or forward end of upper 28. Alternatively, toecap 30 may not be used or may be formed of a different material from the rest of base 24, such as rubber. The function of toecap 30 is to protect the forward end of upper 28 from wear and water. In some boot-to-snowboard arrangements toecap 30 may slightly extend over the edge of snowboard 22. Thus, toecap 30 would function to protect not only upper 28, but also the foot of the user from injury. Toecap 30 also extends around the side of the ball of the foot of the user. This arrangement adds additional lateral and torsional support to the foot of the user.

Base 24 also includes a heel counter 32 extending upwardly from the heel or rearward end of base 24. Heel counter 32 surrounds and cups the heel portion of upper 28 and provides lateral support to the heel of the user. As with toecap 30, heel counter 32 is preferably formed as an integral part of base 24. Alternatively, however, heel counter 32 could be constructed of a different material and attached to base 24.

Tread 34 extends downwardly from base 24. Tread 34 is preferably formed of a different material than the remainder of base 24. The construction of tread 34 is preferably like that of conventional snow boots such as those sold under the Sorels name. Tread 34 may alternatively be constructed of a Vibram rubber, as commonly used on hiking boots; base 24 may also include a metal or plastic composite shank. The toe end of tread 34 angles upwardly toward toecap 30 so as not to interfere with edging of the snowboard if the toe end of boot 20 extends slightly over the edge of the snowboard. The heel end of tread 34 also angles upwardly toward heel counter 32 at an angle of about 45 degrees.

Highback 26 is pivotally connected to heel counter 32 by a highback pivot 36. This pivot is preferably a heavy-duty rivet, but may alternatively be any other type of conventional pivoting fastener connection. In the alternative embodiments, discussed below, highback pivot 36 may be shifted rearwardly or may not be used at all. Heel counter 32 includes an upward projection to allow highback pivot 36 to be placed just beneath the ankle bone of the user for proper pivotal movement of highback 26. Highback 26 is preferably formed of a resilient plastic material that is rigid enough to provide the desired ankle support to the user. Highback 26 extends upwardly from heel counter 32, adjacent the rear, and portions of the sides of upper 28. Highback 26 preferably provides greater aft support than lateral support, as will be explained below.

In the embodiment illustrated in FIG. 2, highback 26 includes a cuff 38 that extends completely around upper 28 above the ankle of the user. A highback strap 40 is attached to cuff 38 to fasten the opposing ends of cuff 38 together and help secure the foot of the user within upper 28.

Upper 28 is fixedly attached to base 24 by being secured beneath the last (not shown) of base 24. Toecap 30 and heel counter 32 may also be glued to upper 28. However, highback 26 is preferably not fixedly attached to upper 28, to allow for relative movement between the two. Upper 28 extends above highback 26. Upper 26 also includes laces (not shown) and lace cover 42 to protect the laces and the foot of the user from snow, ice, and entering moisture. Lace cover 42 is connected to upper 28 adjacent toecap 30 and is held in place over the laces by hook-and-loop fasteners (not shown) under its edges. Upper 28 is preferably constructed principally of leather, but may alternatively be formed from ballistic nylon or other flexible, natural or manmade material. A conventional tongue 44 is also provided within upper 28.

In the embodiment shown in FIG. 2, an upper strap 46 is fastened between the opposing sides of upper 28 above cuff 38. Upper strap 46 helps secure the top portion of upper 28 to the leg of the user. Upper strap 46 uses a hook-and-loop type fastener and folds back on itself after being threaded through a buckle (not shown). A liner 48 including padding is sewn within upper 28 to receive, cushion, and insulate the foot of the user.

One other feature of boot 20 illustrated in FIGS. 2 and 3 is a bottom lip 50 and a stop block 52. Bottom lip 50 is formed integrally from the rearward edge of heel counter 32. Bottom lip 50 projects outwardly. Stop block 52 is fastened to the rearward side of highback 26 directly above bottom lip 50. As the lower edge of stop block 52 contacts the upper edge of bottom lip 50, pivotal rotation of highback 26 is stopped. The position of stop block 52 can be changed to vary the angle of highback 26 for greater or less forward lean. Stop block 52 and bottom lip 50 are seen in more detail in FIG. 9.

Figure 4A:
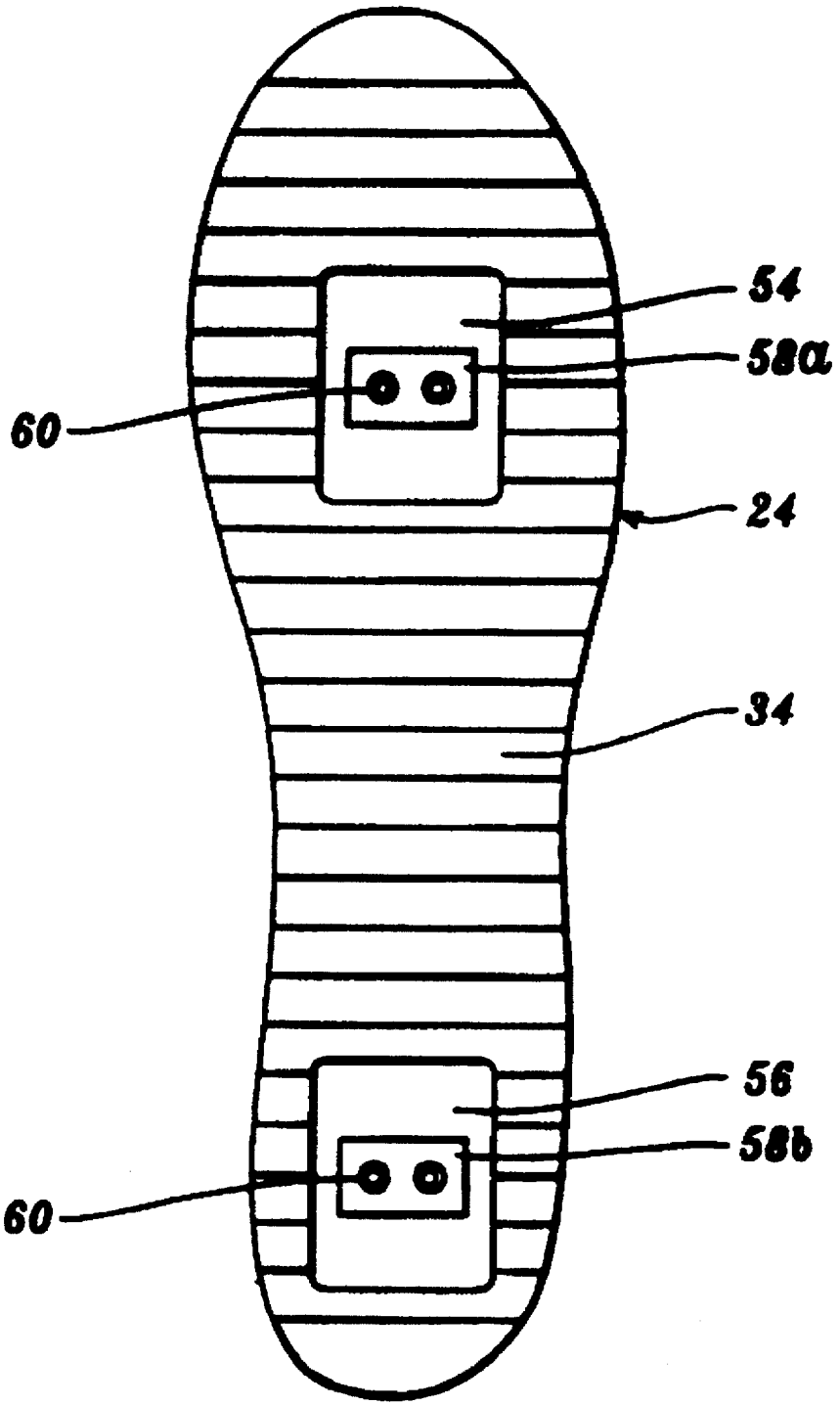
FIG. 4A is a bottom view of the boots illustrated in FIGS. 1 through 3, showing binding attachment plates within recesses.
Figure 4B:
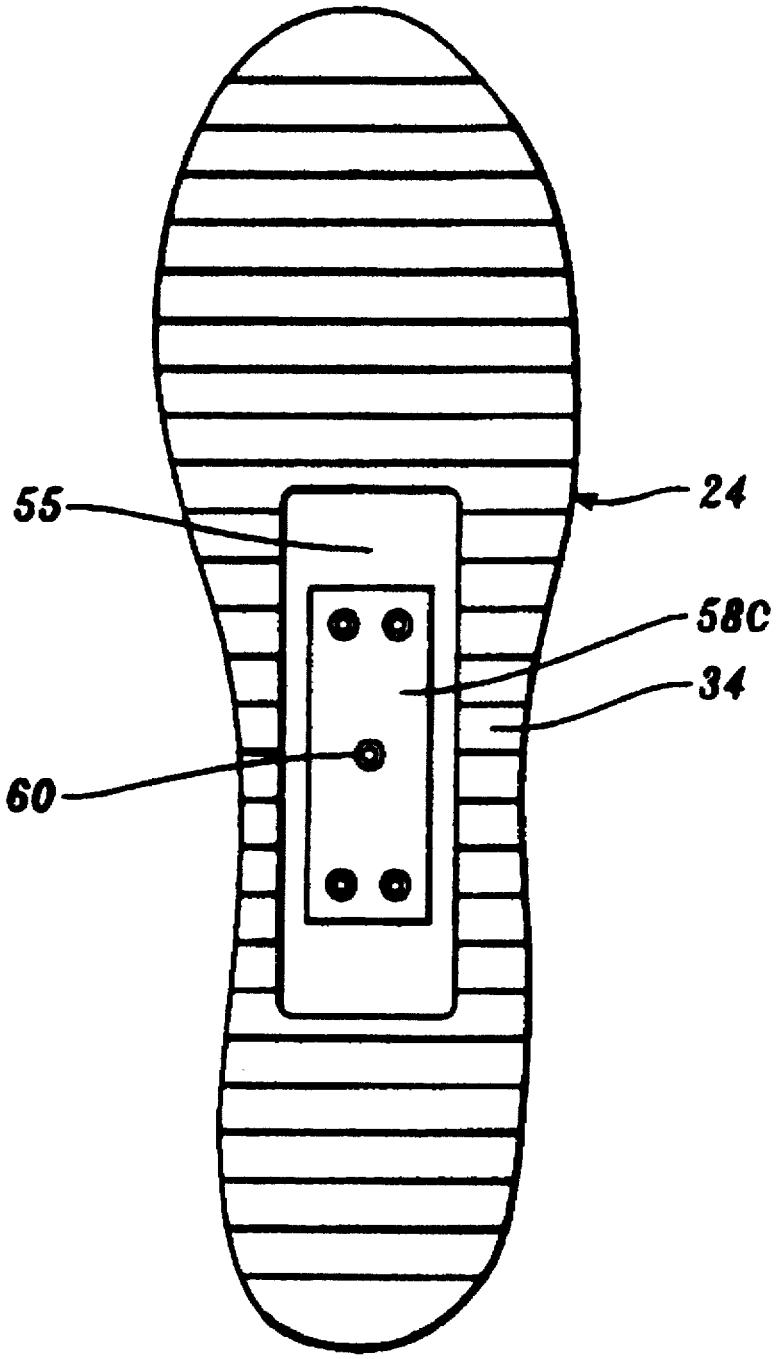
FIG. 4B is a bottom view of a second embodiment of the boot, showing one binding attachment plate within a recess.

Two different embodiments of the bottom of boot 20 are illustrated in FIGS. 4A and 4B. A basic tread pattern is shown in FIGS. 4A and 4B, although, alternatively, any tread pattern could be used. In the embodiment shown in FIG. 4A, base 24 includes a forward recess 54 and a rearward recess 56. Recesses 54 and 56 are surrounded by tread 34. Recesses 54 and 56 are preferably rectangular but could be any configuration needed to interface with step-in snowboard bindings. Forward and rearward boot plates 58 are mounted inside recesses 54 and 56. Boot plates 58 are secured by fasteners 60. Boot plates 58 are also rectangular, although somewhat smaller than recesses 54 and 56 so as to allow room for the jaws of snowboard bindings to grasp the edges of boot plates 58. Preferably, the minor axes of boot plates 58 are parallel to the longitudinal axis of base 24.

In the embodiment shown in FIG. 4B, base 24 includes a single recess 55 surrounded by tread 34. Recess 55 is preferably rectangular but, alternatively, could be any shape desired to interface with step-in snowboard bindings. Boot plate 58*c* is mounted inside recess 55 and secured by fasteners 60. Boot plate 58*c* is also preferably rectangular and is somewhat smaller than recess 55. The major axis of boot plate 58*c* is preferably parallel to the longitudinal axis of base 24.

Figure 5:
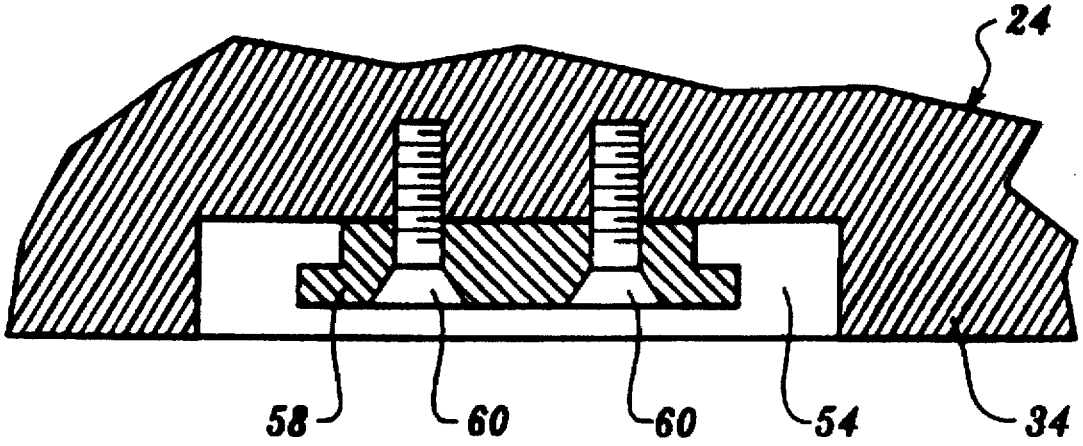
FIG. 5 is a cross-sectional view of the binding attachment plate secured to the base of the boot.

FIG. 5 illustrates a cross-sectional view of boot plate 58. In cross section, boot plate 58 has an upside-down T shape providing projecting edges onto which the jaws of the snowboard binding may grasp. FIG. 5 also shows how the bottom of tread 34 projects beneath the level of boot plate 58.

Figure 6A:
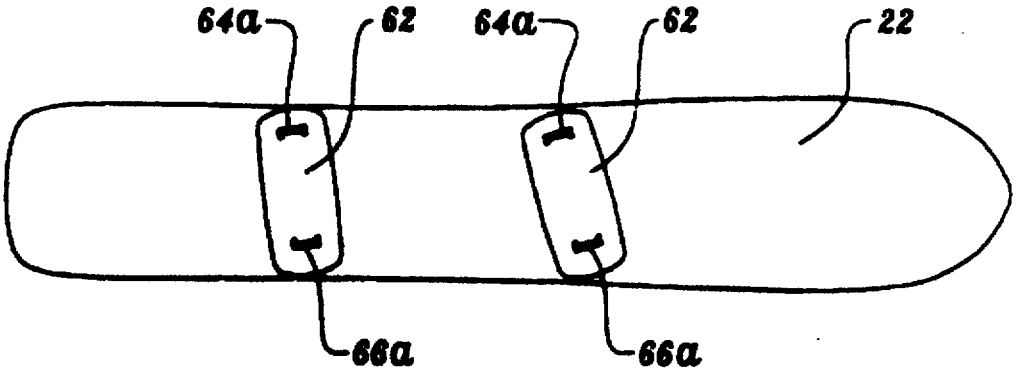
FIG. 6A is a top view of a snowboard illustrating one embodiment of the bindings.
Figure 6B:
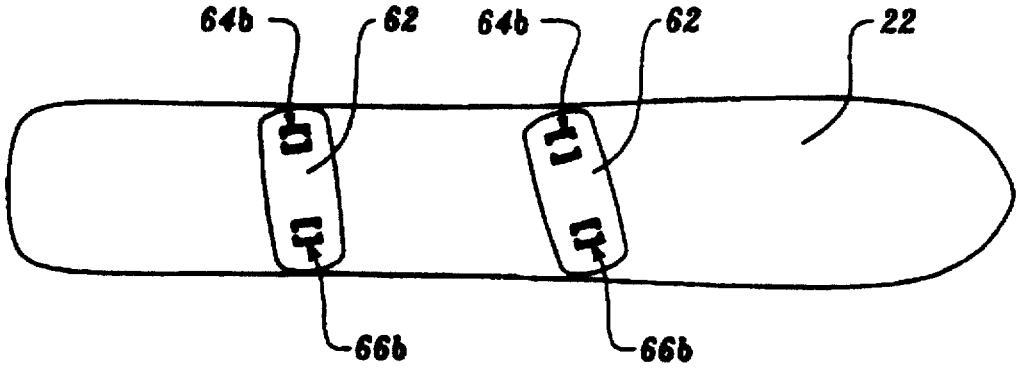
FIG. 6B is a top view of a snowboard illustrating another embodiment of the bindings.
Figure 6C:
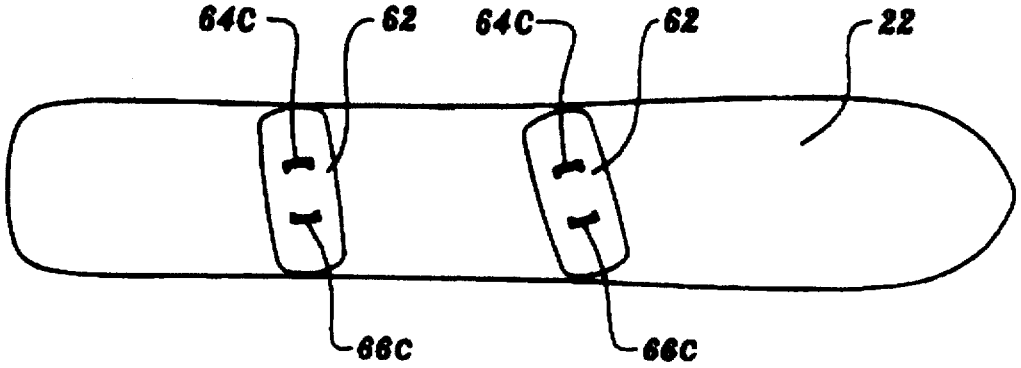
FIG. 6C is a top view of a snowboard illustrating an embodiment of the bindings to be used with the boot shown in FIG. 4B.

FIGS. 6A, 6B, and 6C illustrate one type of binding in three different arrangements that may be used in connection with boot 20 of the present invention. The bindings shown are step-in bindings similar in some ways to step-in ski bindings. A binding plate 62 is fastened to snowboard 22. Binding plate 62 is large enough for most of tread 34 to fit thereon. Toe bindings 64 and heel bindings 66 are fastened to binding plates 62. Toe and heel bindings are spring-biased jaws that engage boot plates 58 to hold boot 20 in place. The jaws of bindings 64 and 66 grip around the edges of boot plates 58 and limit the movement of boot plates 58 in all directions.

The arrangement shown in FIG. 6A may be used when base 24 of boot 20 is rigid enough to hold the forward and rearward boot plates 58 at a constant distance apart. A less rigid base 24 may be used with bindings 64*b* and 66*b* illustrated in FIG. 6B, since forward and rearward plates 58 are held on all sides by individual bindings. FIG. 6C illustrates an arrangement of bindings 64*c* and 66*c* for attachment to a single boot plate 58*c* as illustrated in FIG. 4B. One toe binding 64*c* attaches to the front of boot plate 58*c* and one heel binding 66*c* attaches to the rear of boot plate 58*c*. Other arrangements are obviously possible. Currently available plate bindings may also be used to hold boot 20 to snowboard 22. For this purpose ridges could be provided at the toe and heel of boot 20 to receive the toe and heel bails of such conventional plate bindings, such as those made by Emery or Burton, to be used with mountaineering-type boots. A less rigid base 24 for boot 20 may be desirable for comfortable walking when not snowboarding.

Figure 7:
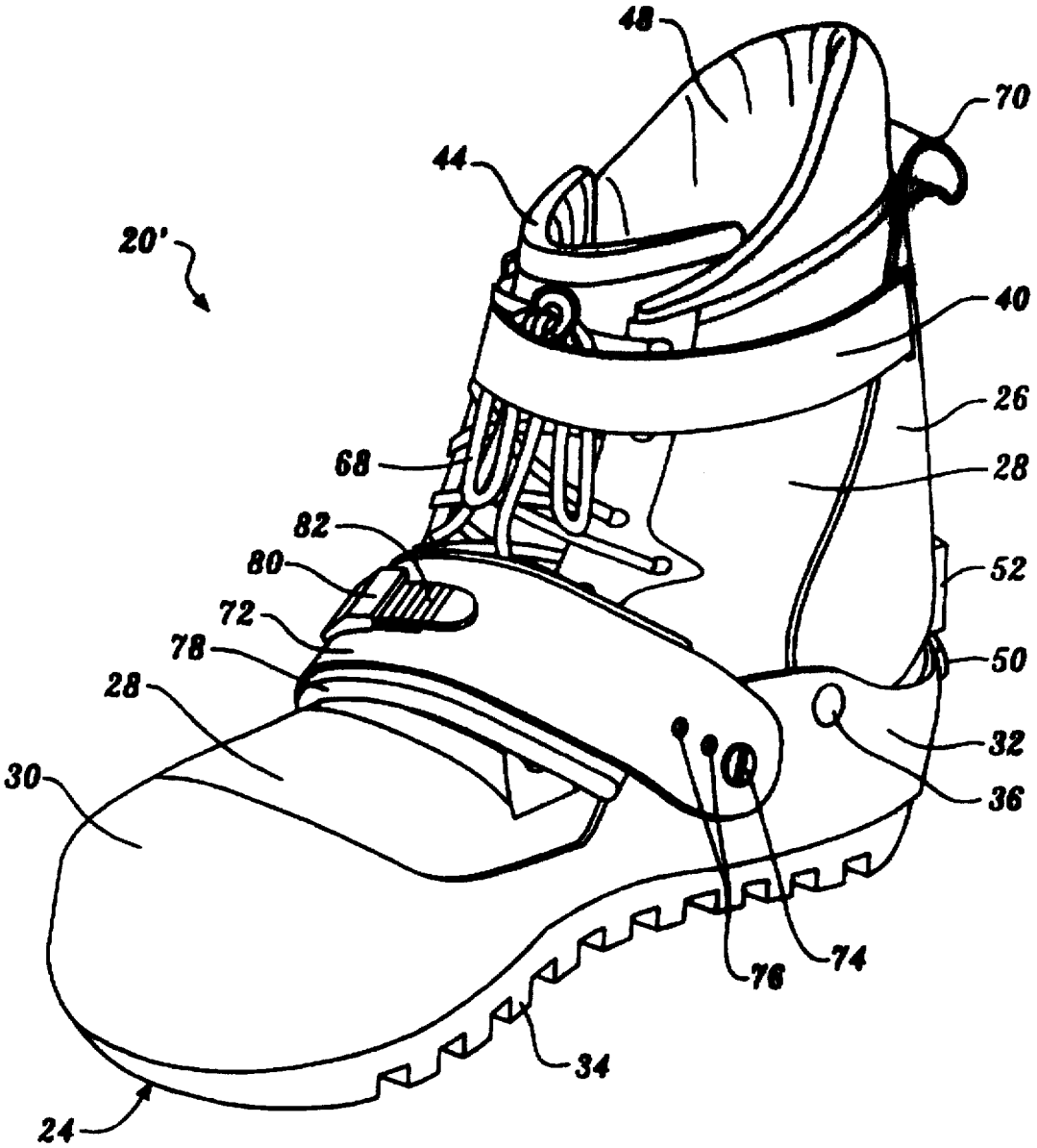
FIG. 7 is a perspective view of another embodiment of the boot of the present invention including both base and highback straps.
Figure 8:
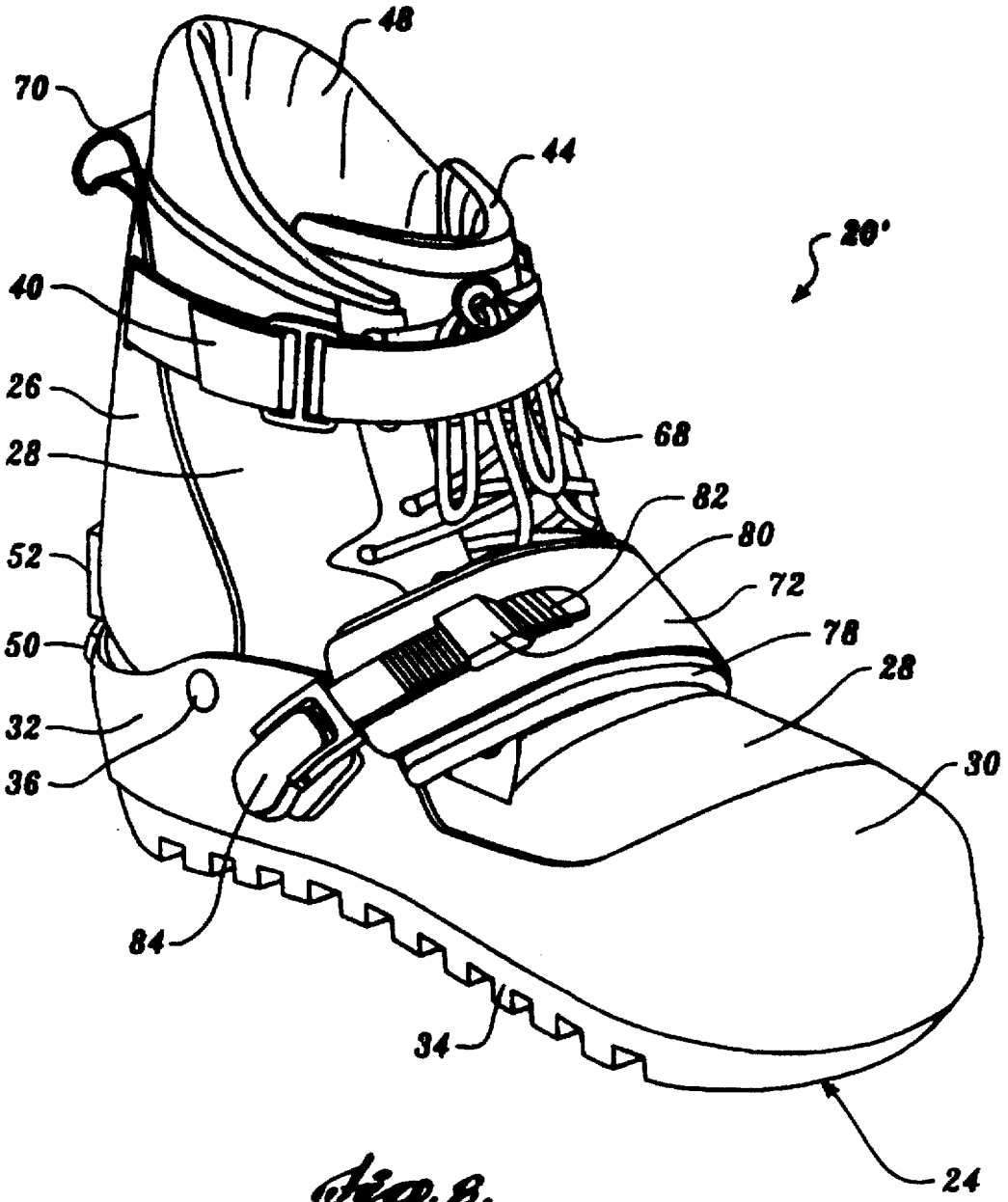
FIG. 8 is a perspective view of the boot illustrated in FIG. 7, showing the opposite side of the boot.
Figure 9:
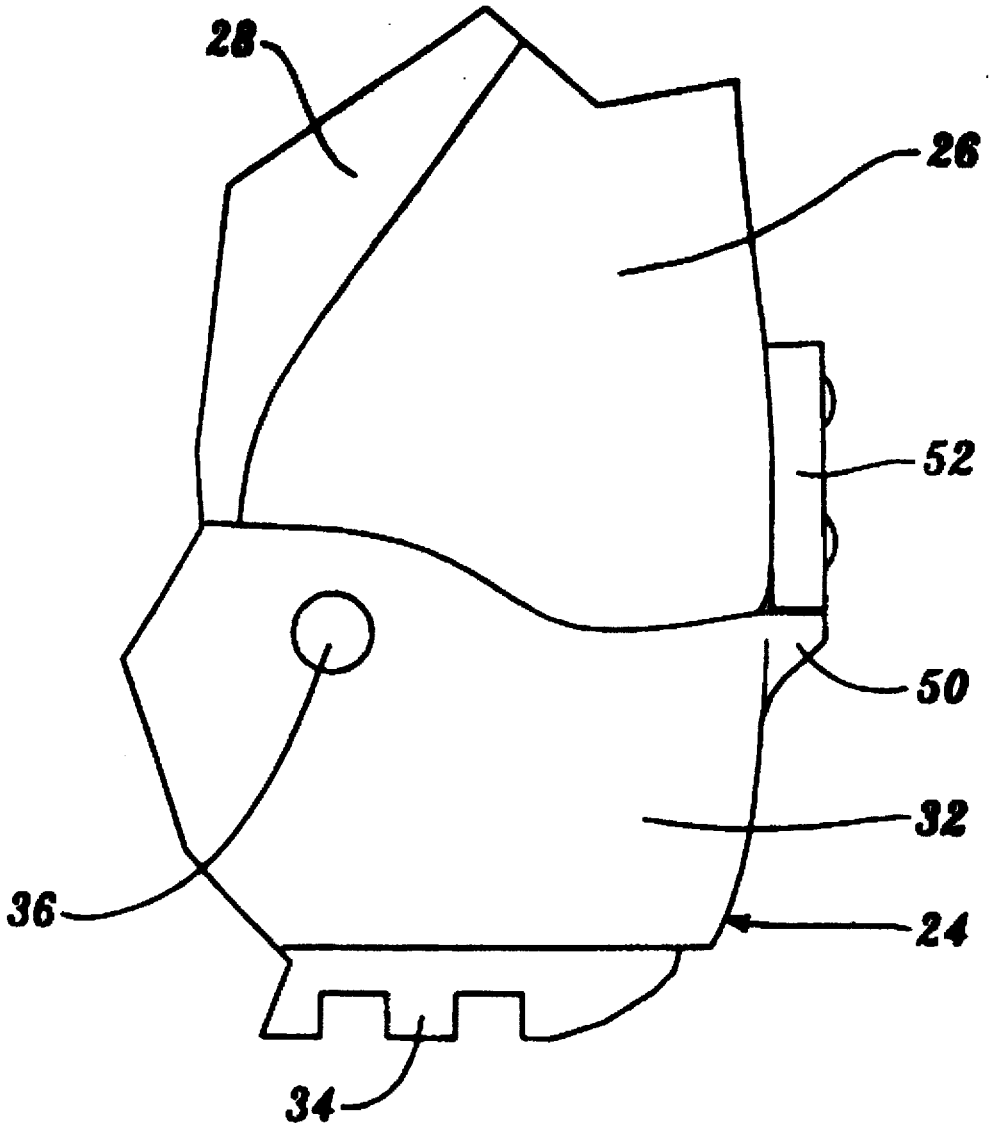
FIG. 9 is a side elevational view of the heel of the boot of FIGS. 7 and 8, illustrating the back stops that limit aft movement of the highback.

An alternate embodiment of boot 20 is illustrated in FIGS. 7 through 9. The major differences between this embodiment and that illustrated in FIGS. 1 through 3 will now be discussed. Besides its generally builder appearance, due to increased insulation and thickness of materials for added durability, boot 20' also includes exposed laces 68, a loop 70, and a base strap 72. Although a lace cover could alternatively be used, laces 68 are exposed and extend to the top of upper 28 of boot 20'. Loop 70 is attached to the back of upper 28. Loop 70 is preferably formed of leather. The function of loop 70 is simply to aid the user in putting on boot 20'.

Boot 20' also includes base strap 72 connected to the opposing sides of base 24 and extending over the top of upper 28 in front of the ankle of the user. Heel counter 32 actually extends forward for attachment of base strap 72. Heel counter 32 distributes the pressure to the heel end of base 24 of boot 20' A strap fastener 74 secures base strap 72 on the inside and a buckle 84, ratchet 80, and serrated base strap 82 secure base strap 72 on the outside. Strap fastener 74 is standard screw fit within a receiving sleeve (not shown) engaged within base 24. Adjustment holes 76 are provided along the end of base strap 72 for major adjustments of base strap 72 by fastening a different hole with strap fastener 74. Base strap 72 is preferably constructed of a strong plastic or composite material, but may alternatively be metal, leather, or other material that can withstand the forces involved. Strap padding 78 is attached to the underside of base strap 72. Strap padding 78 is formed from foam with a urethane cover.

Buckle 84 is riveted to the opposite side of heel counter 32. Buckle 84 secures serrated base strap 82 and provides leverage for tightening base strap 72. Alternatively, other types of buckles or tightening devices could be used. With the buckle arrangement shown in FIG. 8, base strap 72 is tightened by elevating buckle 84, sliding serrated base strap 82 a desired distance within ratchet 80, and closing buckle 84.

Another difference between boot 20' illustrated in FIG. 7 and boot 20 illustrated in FIGS. 1 through 3 is the configuration of highback 26. Highback 26 of boot 20' does not have a cuff extending around the front of upper 28. This allows for more lateral flexibility of boot 20', while still providing complete aft support. Some additional support to upper 28 is provided by highback strap 40, which, in this embodiment, is simply a strap with a hook-and-loop fastener extending from slots in highback 26. Highback 26 slightly recedes from the sides of upper 28 as highback 26 extends upwardly along the back of upper 28 to allow increased lateral flexibility.

FIG. 9 illustrates the back of boot 20' and shows stop block 52 and bottom lip 50 in greater detail. Stop block 52 and bottom lip 50 are substantially the same in the embodiment shown in FIGS. 1 through 3. Stop block 52 is held with two fasteners that can be undone for removal or reversal of block 52. Block 52 extends farther from the holes on one side than the other such that reversal changes the forward-lean angle of highback 26. Other conventional forward-lean adjustment systems may also be used.

Figure 10:
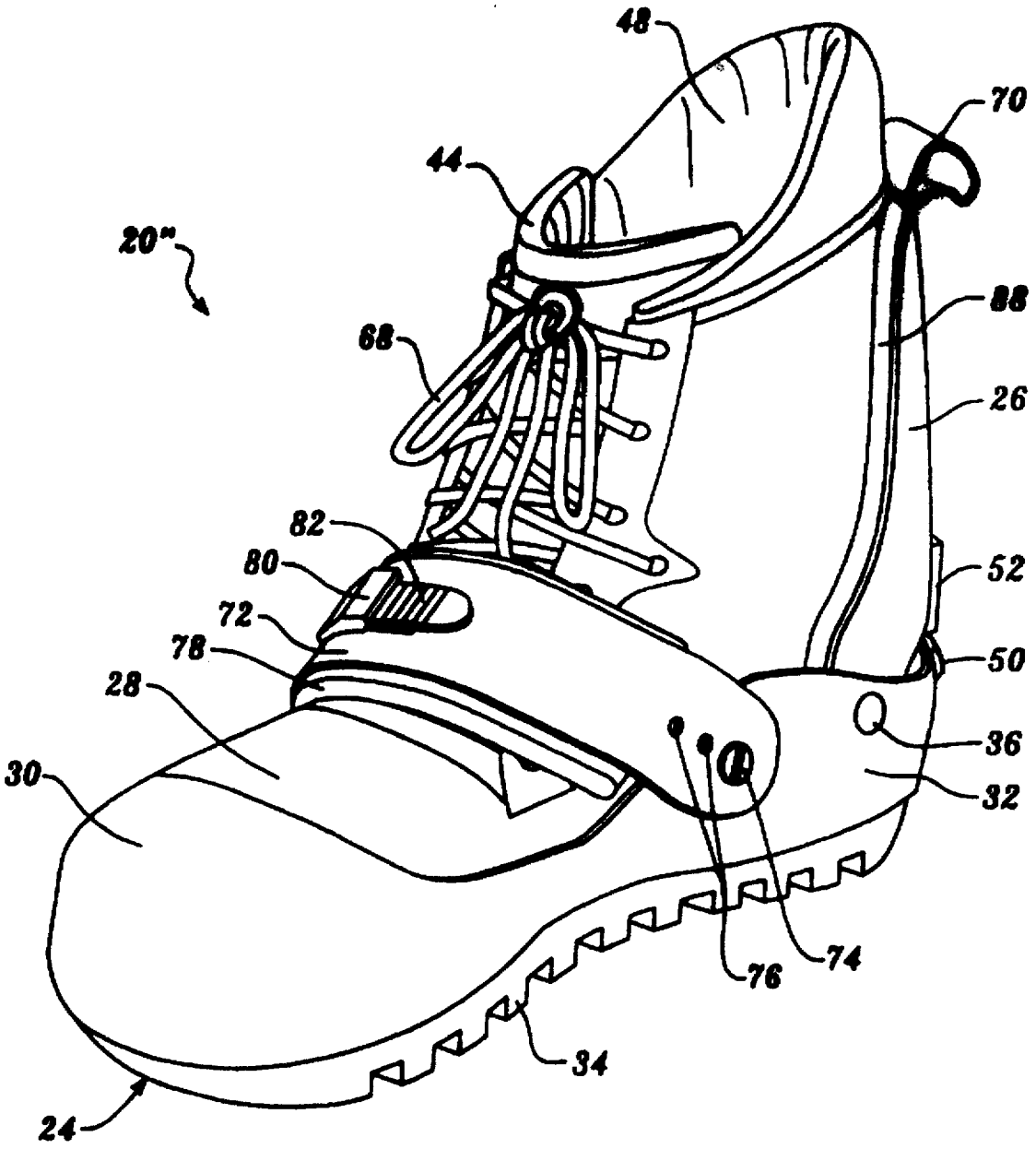
FIG. 10 is a perspective view of an alternate embodiment of the boot of the present invention having no highback strap.

Referring now to FIG. 10 another alternate embodiment of the present invention will be discussed. Boot 20" illustrated in FIG. 10 varies from boot 20' of FIG. 7 by changes made to highback 26. Highback 26 does not include a strap and does not extend as far around the side of upper 28. Thus, greater lateral flexibility is provided. Highback pivot 36 is also shifted slightly farther toward the rearward end of heel counter 32. Highback padding 88 is attached to the inside surface of highback 26 of boot 20". Highback padding 88 could be added to any embodiment disclosed herein.

Figure 11:
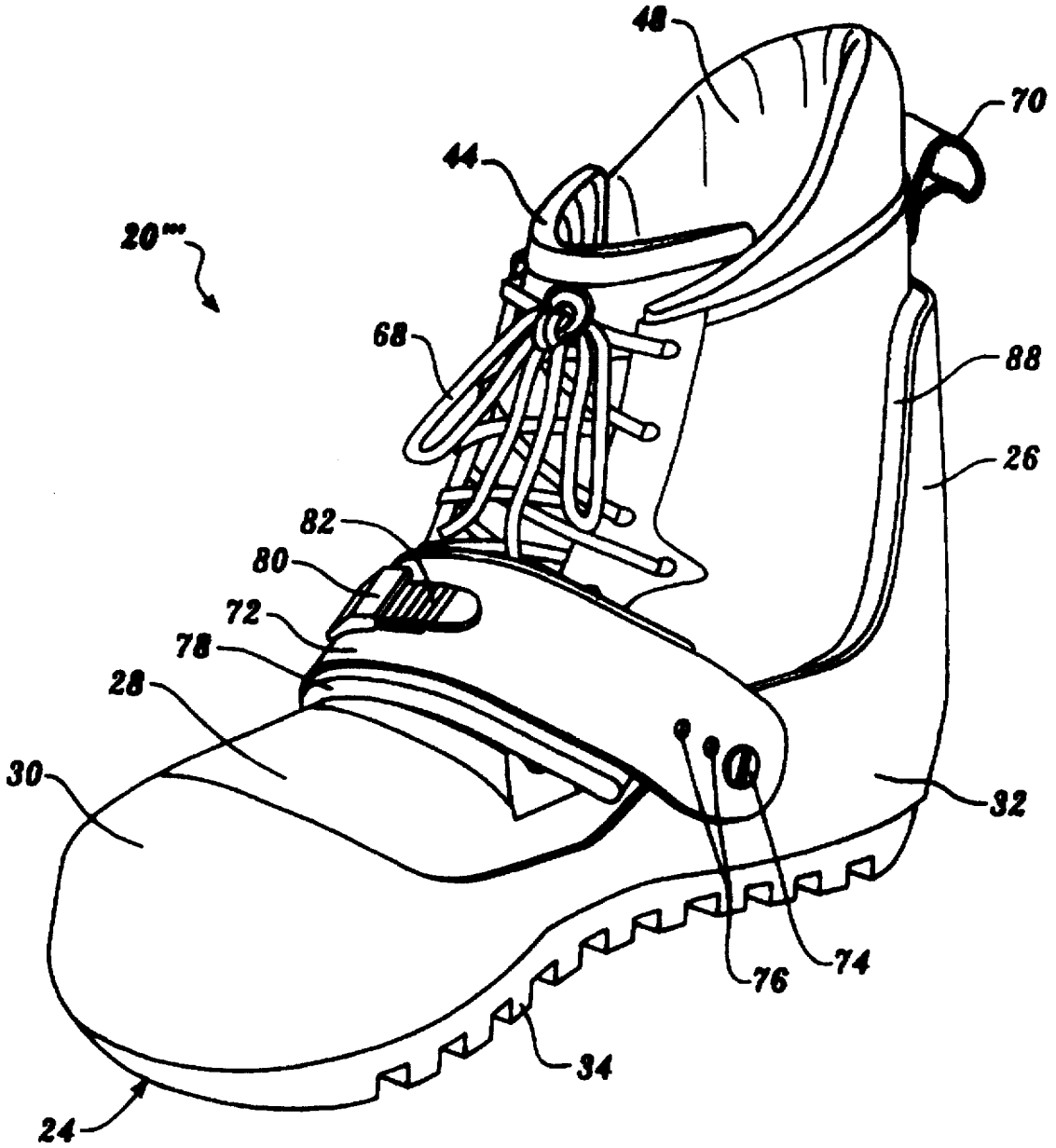
FIG. 11 is a perspective view of another alternate embodiment of the boot of the present invention having an integral highback.

FIG. 11 illustrates another embodiment of the present invention. In this embodiment highback 26 is an integral extension of heel counter 32, instead of being hingeably attached to heel counter 32. A high degree of lateral movement is allowed, while ark movement is restricted by highback 26. A highback strap such as that illustrated in FIG. 7 may be added to increase lateral stiffness as desired. Bottom lip 50 and stop block 52 are not used with the integral highback structure.

An embodiment of the binding of the present invention will now be described with reference to FIGS. 12–15. Three modifications of that preferred design will then be discussed with reference to FIGS. 16–20.

Figure 12:
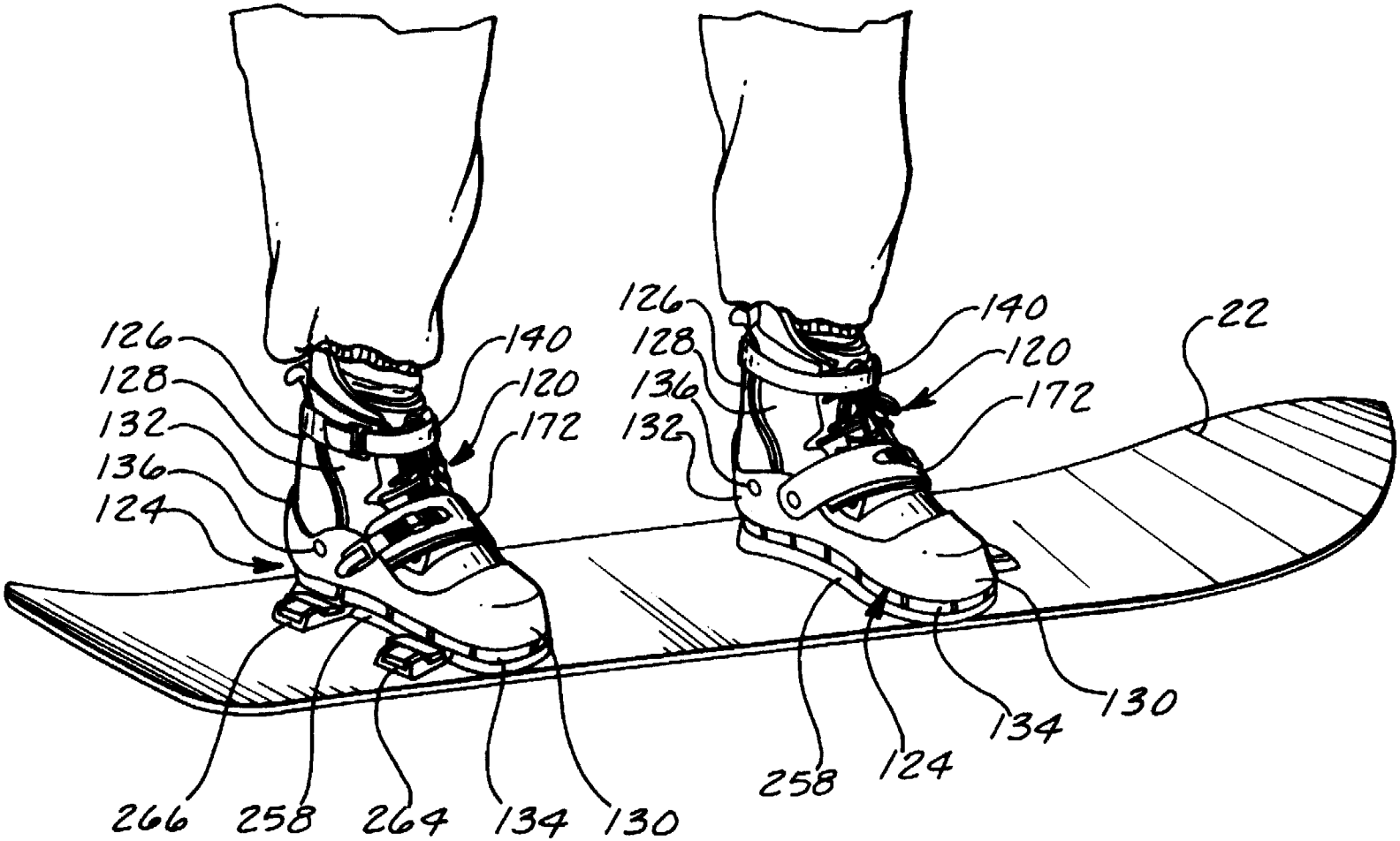
FIG. 12 is a perspective view of one embodiment of the snowboard boots and bindings, showing the boots attached to a snowboard with the bindings.

Boots 120 are shown secured to snowboard 22 in FIG. 12. Boots 120 are similar to those described above with reference to FIG. 8. Each of boots 120 includes a base 124, a highback 126, an upper 128, a toecap 130, a heel counter 132, tread 134, and a highback strap 140. The base and tread make up the sole. These numbers correspond to the numbers described with reference to FIG. 8, except that a "1" has been added in front of like two-digit numbers in FIG. 8. Thus, the elements of the boot in this embodiment are generally numbered between 100 and 199.

The elements of the binding of this embodiment are numbered in the 200s. The binding includes a binding plate 262, a toe binding 264, and a heel binding 266. The boot plate is secured to snowboard 22 beneath the area over which boot 120 rests when attached to toe and heel bindings 264 and 266. Portions of toe and heel bindings 264 and 266 extend laterally outward from the outer sides of binding plates 262.

Figure 13:
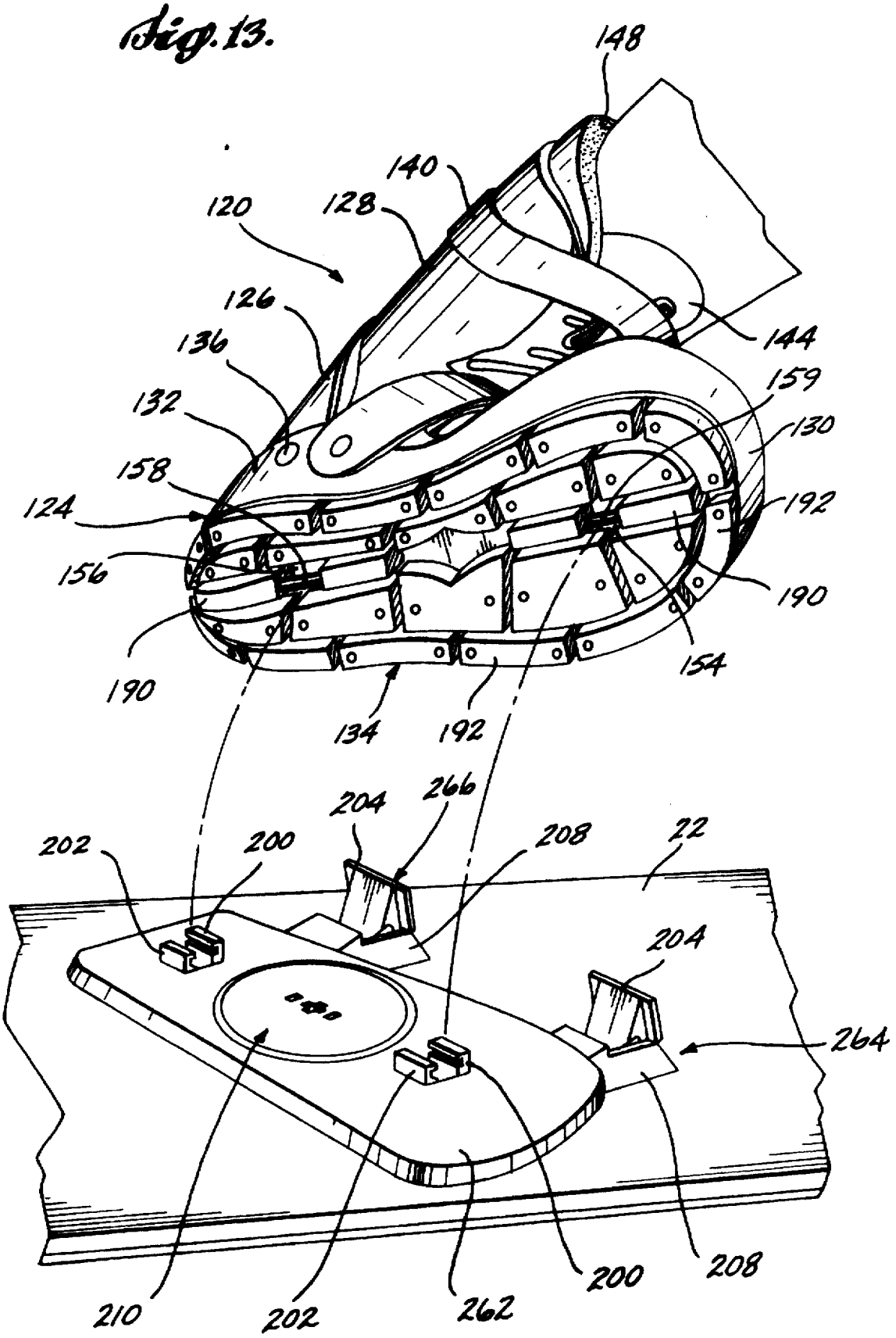
FIG. 13 is a perspective view of the bottom of the boot showing its alignment with one embodiment of the snowboard bindings.

FIG. 13 illustrates the basic elements of the bottom of boot 120 as well as toe and heel bindings 264 and 266. Tread 134 of boot 120 is constructed of numerous flex pads 192 that are secured to base 124 of boot 120. Flex pads 192 are preferably constructed of a deformable resilient rubber-like material. Thus, flex pads 192 may be slightly compressed when sufficient force is applied to them against binding plate 262. Flex pads 192 include a stiffer layer on their upper sides for secure attachment to base 124. The compressibility of flex pads 192 allows for lateral and medial movement of boot 120 about the attachment of boot 120 to toe and heel bindings 264 and 266. Since flex pads 192 are preferably removably attached to base 124, flex pads of differing durometers may be attached to achieve a desired amount of medial and lateral flex or pivotal movement about the attachment of boot 120 to toe and heel bindings 264 and 266. Flex pads 192 of greater thicknesses may also be employed to change the cant of boot 120.

A toe rod 159 and a heel rod 158 are secured between flex pads 192 to base 124 of boot 120. Toe rod 159 and heel rod 158 are preferably constructed of steel rods that extend along the same axis, generally parallel and along the longitudinal axis of the sole of boot 120. Rods 158 and 159 are secured to base 124 with supports or blocks 190. Blocks 190 are preferably parallelepiped in shape and lie along the same axis as rods 158 and 159. Blocks 190 may be of a higher durometer than that of flex pads 192, since pivotal movement of boot 120 about rods 158 and 159 will be about the same axis. In other words, boot 120 may rock or pivot on blocks 190. Blocks 190 are secured in front of and behind each of rods 158 and 159 such that they form a substantial ridge along the longitudinal center of the sole of boot 120.

Binding plate 262 is secured to snowboard 22 in a preferred orientation and is held down in that orientation by an adjustment plate 210. Adjustment plate 210 is secured with screws to snowboard 22, as described in further detail below in conjunction with FIG. 20. Binding plate 262 forms a surface upon which flex pads 192 rest and are compressed.

Toe and heel bindings 264 and 266 in this embodiment are identical. Each includes a static or stationary jaw 200 and an active or movable jaw 202, which clamp onto rods 158 and 159. Static jaw 200 remains in place and provides a recess into which active jaw 202 may extend when closed. Static jaw 200 projects upwardly from binding plate 262 a sufficient distance that it may project within one of recesses 156 and 154 surrounding rods 158 and 159, respectively. Static jaw 200 projects within one side of the recess, while active jaw 202 projects within the other side so as to surround the rod. The upper portion of static jaw 200 is C shaped while the upper portion of active jaw 202 is in the shape of an inverted L. Active jaw 202 thus engages static jaw 200 when closed to completely surround the rod over which it is secured. A lever 204 is used to move active jaw 202 in a lateral or medial direction with respect to boot 120. In FIG. 13 levers 204 are shown in an open position such that active jaws 202 are separated from static jaws 200.

Figure 14:
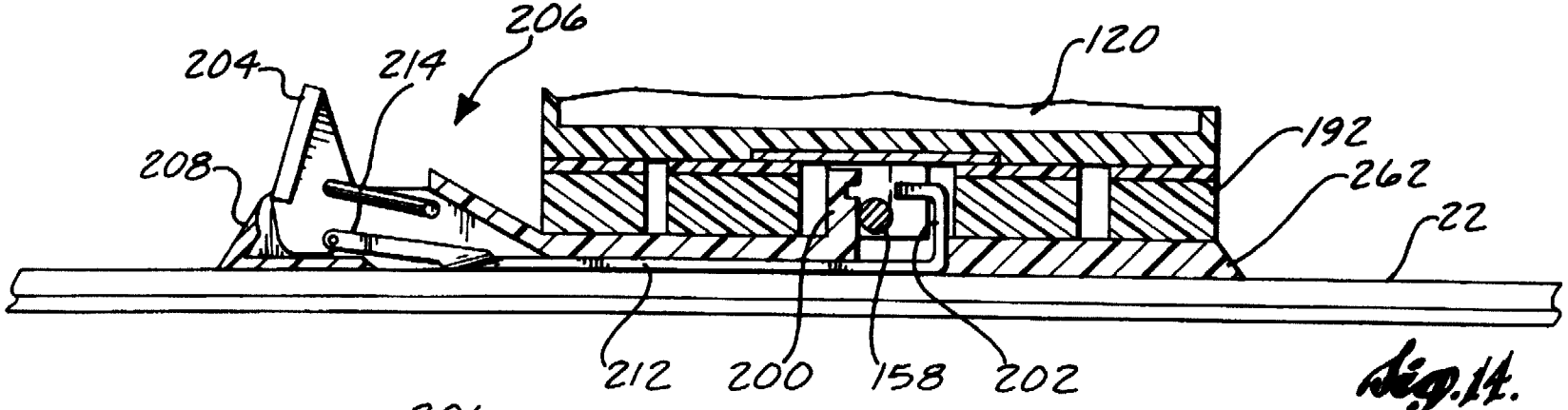
FIG. 14 is a cross-sectional elevational view of one embodiment of a binding shown in an open position.
Figure 15:
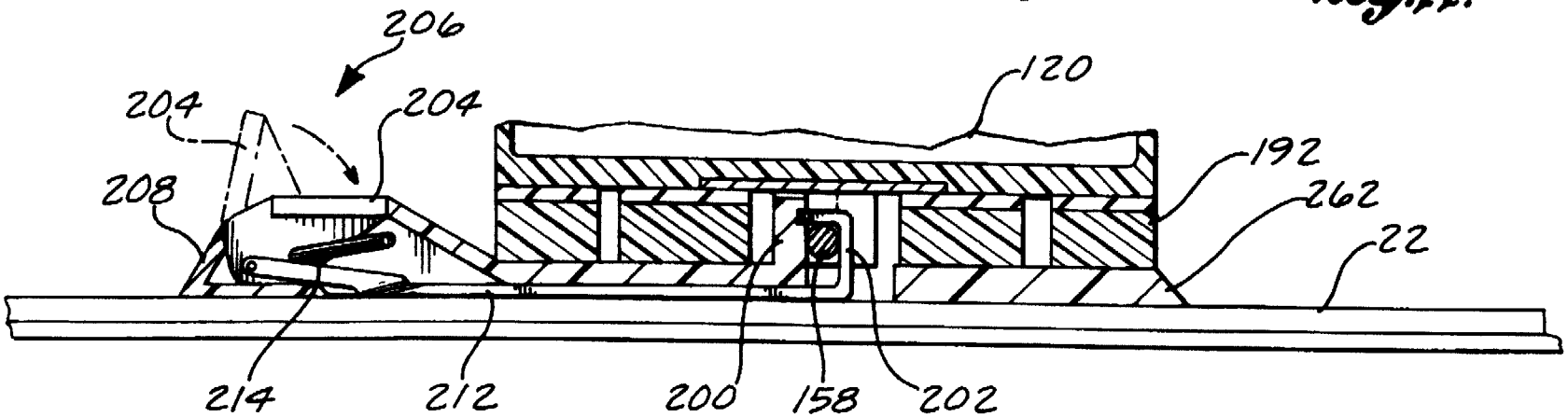
FIG. 15 is a cross-sectional elevational view of the binding illustrated in FIG. 14 shown in a closed position.

FIGS. 14 and 15 illustrate the binding mechanism 206 of both the toe binding 264 and the heel binding 266. As seen in FIG. 14, when active jaw 202 is in an open position relative to static jaw 200, a sufficient space is created between the jaws such that rod 158 can fit between them. Thus, lever 204 is in the up position, allowing the boot to be inserted between the jaws before being secured by the binding. The binding mechanism includes a housing 208, lever 204, linkage 214, slide plate 212, and jaws 200 and 202. Lever 204 is pivotally connected to linkage 214 at approximately the middle of lever 204. Linkage 214 is also pivotally connected, at its other end, to housing 208. The bottom end of linkage 204 is pivotally connected to slide plate 212. Slide plate 212 extends from the bottom portion of lever 204 beneath a portion of housing 208 and integrally connects with active jaw 202. Movement of lever 204 pivots lever 204 about its pivotal connection to linkage 214, which is held in place by its connection to housing 208. Movement of lever 204 thus translates slide plate 212 in a lateral or medial direction to open or close active jaw 202 relative to static jaw 200. Static jaw 200 may be an integral portion of housing 208 and preferably extends upwardly therefrom, as explained above.

The closed position of binding mechanism 206 is illustrated in FIG. 15. Lever 204 has been pressed downwardly, thus pulling slide plate 212 in a lateral direction and thereby closing active jaw 202 around rod 158. Rod 158 is thus held captive between static jaw 200 and active jaw 202. The C-shaped recess into which the end of active jaw 202 rests also helps to counter any upward forces applied against active jaw 202 by rod 158. As lever 204 is closed, the pivotal connections of linkage 214 and slide plate 212 to lever 204 initially cause lever 204 to pass an overcenter position, such that the closed position is maintained when force is applied to active jaw 202. Thus, the pivotal connection of slide plate 212 to lever 204 is such that it is above the axis of linkage 214.

Figure 16:
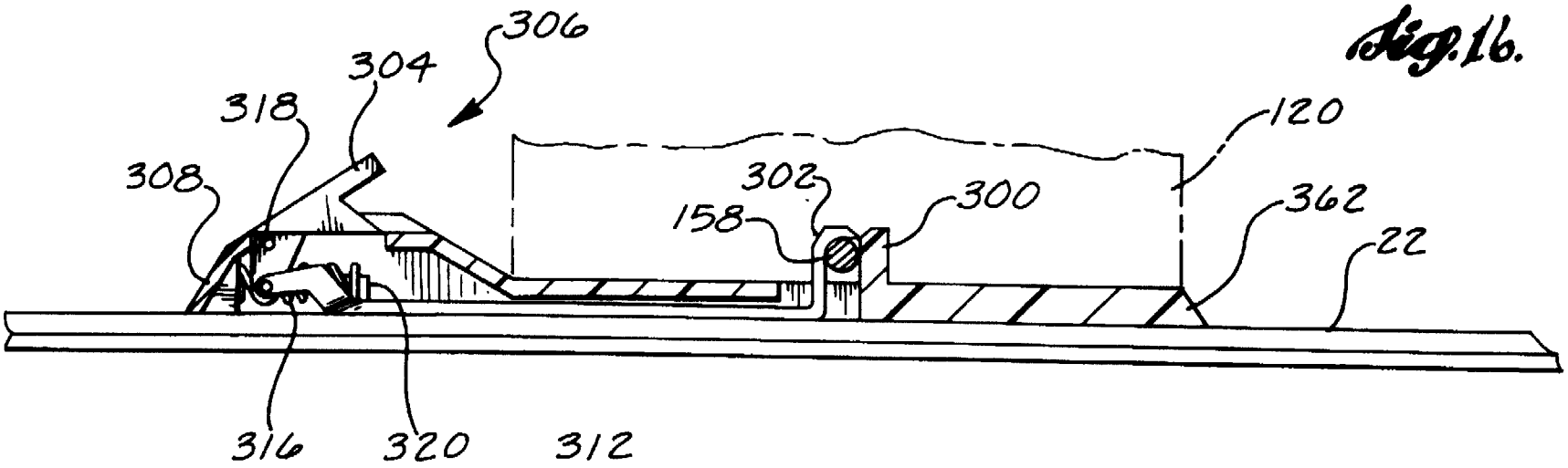
FIG. 16 is a cross-sectional elevational view of another embodiment of a binding shown in a closed position.
Figure 17:
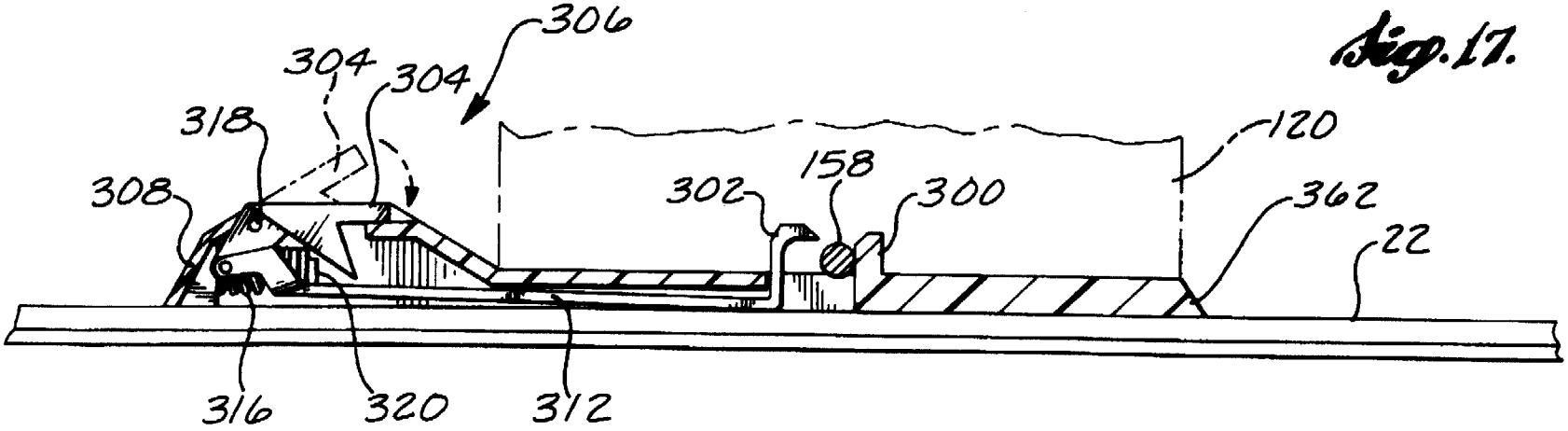
FIG. 17 is a cross-sectional elevational view of the binding illustrated in FIG. 16 shown in an open position.

FIGS. 16 and 17 show an alternate mechanism that may be used with the same boot 120. Binding mechanism 306 includes a lever 304 pivotally attached with a pivot pin 3 18 at its lateral side to housing 308. Lever 304 is pivotally attached at its bottom end to slide plate 312. Slide plate 312 includes an upwardly projecting tab 321 inward of its pivotal connection to lever 304. A cylindrical helical compression spring 316 is disposed between tab 320 and housing 308. Thus, as lever 304 is pressed downwardly, slide plate 312 moves laterally and tab 320 compresses spring 316. Thus, slide plate 312 is biased in a medial direction by spring 316 pressing against tab 320. In this binding mechanism 306, an active jaw 302 is on the lateral side of rod 158 and a passive jaw 300 is on the medial side. Thus, slide plate 312 extends beneath housing 308 and connects to active jaw 302, which projects upwardly through housing 308 on the lateral side of rod 158. To attach boot 120 to binding mechanism 306, rod 158 is simply pressed between active jaw 302 and static jaw 300. An inwardly facing downward angle is provided on the top of both static jaw 300 and active jaw 302, such that a V shape is formed into which rod 158 may be pressed. As rod 158 is pressed into this V shape, a lateral force is applied to jaw 302 and, thus, slide plate 312, such that jaw 302 moves away from static jaw 300 to provide an opening for rod 158 to fit within. Once rod 158 extends beneath the upper portion of jaw 302, jaw 302 is free to close over rod 158 and enclose rod 158 between jaw 302 and static jaw 300. No corresponding V exists on the underside of active jaw 302. Therefore, upward pressure by rod 158 does not cause active jaw 302 to open. Active jaw 302 is opened by pressing downwardly on lever 304 such that spring 316 is compressed and slide plate 312 pulls active jaw 302 away from static jaw 300.

Figure 18:
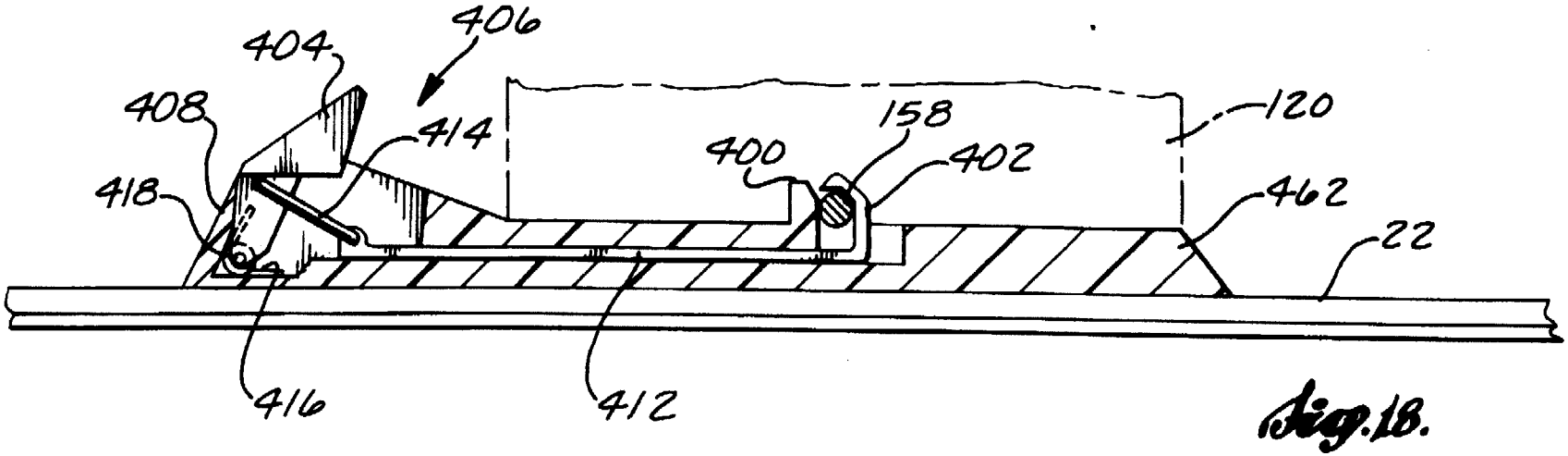
FIG. 18 is a cross-sectional elevational view of another embodiment of a snowboard binding shown in a closed position.
Figure 19:
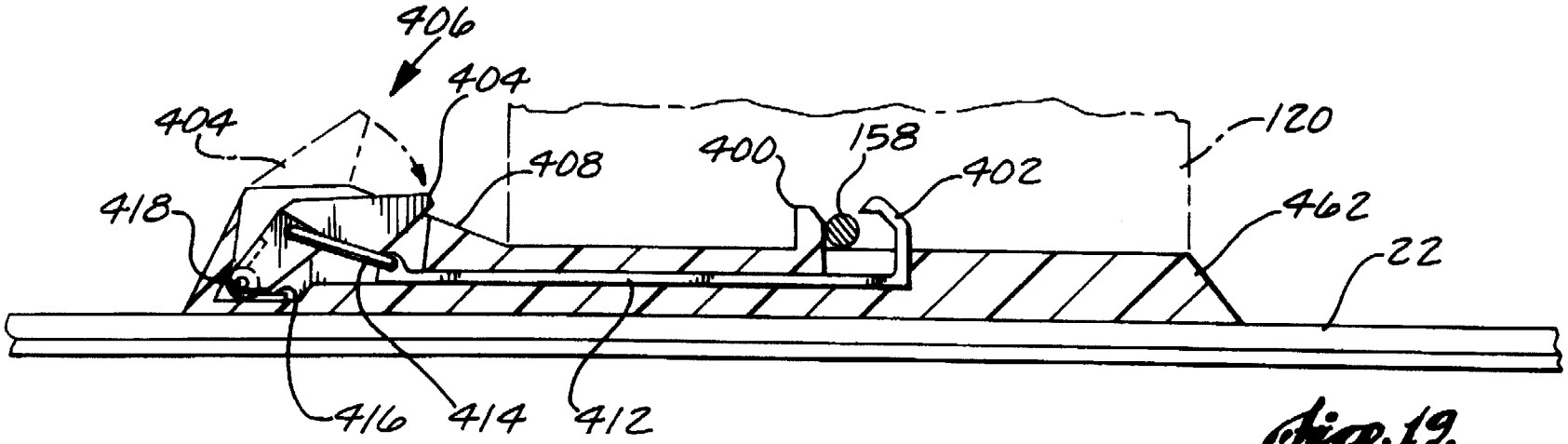
FIG. 19 is a cross-sectional elevational view of the binding illustrated in FIG. 18 shown in an open position.

Another preferred embodiment of a binding mechanism 406 is illustrated in FIGS. 18 and 19. Binding mechanism 406 includes a lever 404 pivotally attached to a housing 408 at its bottom end. A spring 416 is coiled around a pivot pin 418 that pivotally holds lever 404. The ends of spring 416 exert an upward force on lever 404 and a downward force on housing 408. Spring 416 is loaded in a direction perpendicular to its coiled axis, while spring 316 illustrated in FIGS. 16 and 17 is loaded along its longitudinal axis through the center of the coils. A linkage 414 is pivotally coupled to the center of lever 404 and pivotally coupled at its opposite end to a slide plate 412. Slide plate 412 extends within housing 408 beneath a static jaw 400 to integrally connect with active jaw 402. Active jaw 402 extends upwardly from slide plate 412 and includes a hook to surround rod 158. The ends of static jaw 400 and active jaw 402 form a V shape similar to that discussed above with respect to FIGS. 16 and 17. Thus, as rod 158 is pressed against static jaw 400 and active jaw 402, the V separates and allows rod 158 to be enclosed between active jaw 402 and static jaw 400. In this embodiment active jaw 402 is on the medial side of rod 158 while static jaw 400 is on the lateral side.

As illustrated in FIG. 19, as lever 404 is pressed downwardly, linkage 414 moves slide plate 412 in a medial direction to open jaws 400 and 402. Boot 120 can then be removed from binding mechanism 406.

Figure 20:
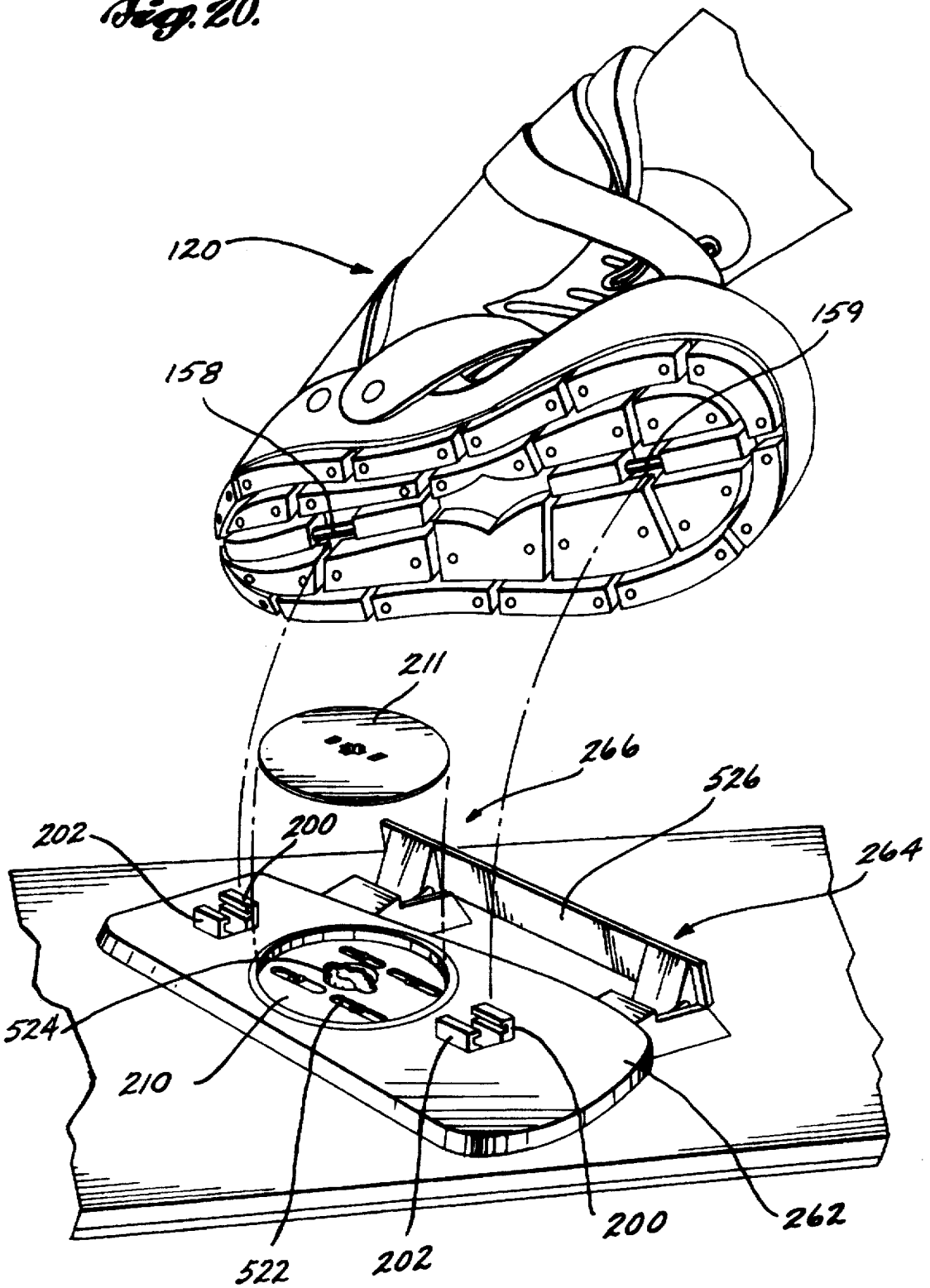
FIG. 20 is a perspective view showing the bottom of a snowboard boot above one embodiment of a snowboard binding having simultaneously opening forward and rearward coupling jaws.

FIG. 20 illustrates a slight modification to toe and heel bindings 264 and 266. In this embodiment, a bar 526 extends between the levers of toe and heel bindings 264 and 266 such that both may be opened and closed together. Also illustrated in FIG. 20 is further detail of adjustment plate 210. Adjustment plate 210 includes a cover 211 that fits into a center slot 224. Cover 211 simply covers slots 522 and screws that fit within slots 522 to secure adjustment plate 210 and, thus, binding plate 262 to snowboard 22. The positioning of binding plate 262 can be adjusted by loosening adjustment plate 210 and rotating the entire binding plate, along with toe and heel bindings 264 and 266, around adjustment plate 210. Adjustment plate 210 is circular to allow this rotation. Binding plate 262 may be shifted in a fore or aft direction by loosening screws within slots 522 and shifting adjustment plate 210 in forward or aft direction, the screws sliding within slots 522.

Any of the described binding embodiments could be used with the above-described boot or, alternatively, with a boot not having a highback, the highback being attached to the binding frame, as is done with cantilevered freestyle snowboard bindings.

Another preferred embodiment of a boot and binding incorporating many of the aspects of the bindings described above, but with a few modifications, will now be described in connection with FIGS. 21–25. This binding includes a toe binding 664 that is different from the heel binding 666. Toe binding 664 is constructed primarily of a hook 650. Heel binding 666 is similar in many regards to binding mechanism 406 illustrated in FIGS. 18 and 19 and described above. Heel binding 666 includes a static jaw 600 and an active jaw 602. Angled portions are provided on the tops of these jaws to form a V shape such that the jaws will separate as boot 720 is pushed down over them.

The basic structure of this alternate binding is formed with the heel binding being held by a rearward bridge 632 that spans the width of the heel of the boot and a forward bridge 634 that spans beneath the boot under the ball of the foot. Forward bridge 634 and rearward bridge 632 are coupled together with side rails 628. Side rails 628 are generally vertical or perpendicular to snowboard 22 and are secured to snowboard 22 with attachment plates 630, which project outwardly and perpendicularly from side rails 628.

Side rails 628 and attachment plates 630 are each formed integrally, preferably of aluminum. The aluminum forms a cross-sectional L shape with side rails 628 being generally rectangular and having their longitudinal axes parallel to the surface of snowboard 22. Each attachment plate 630 lies flat on snowboard 22 and is straight along one edge of connection to side rails 628 and curves outwardly along the other edge, the ends of the outer edge meeting side rails 628. An adjustment slot 622 is provided on each attachment plate 630. Adjustment slot 622 is a segment of a circle approximately concentric with the center of the entire binding mechanism. Screws 646 are provided and engaged within adjustment slots 622 to secure attachment plate 630 and thus the entire binding structure to snowboard 22. Thus, the entire mechanism may be pivotally moved by loosening screws 646, which secure attachment plates 630 to snowboard 22.

Side rails 628 include mounting holes 642 through which forward and rearward bridges 634 and 632 may be secured. Rearward bridge 632 includes flanges 636 at its outer ends for securement to side rails 628. Flanges 636 project upwardly from the outer ends of rearward bridge 632 to lie flat against side rails 628. Holes are also provided within flanges 636 such that fasteners 640 can secure rearward bridge 632 to side rails 628. Flanges 638 are likewise provided on the ends of forward bridge 634 and perform a similar function for forward bridge 634 as flanges 636 perform for rearward bridge 632.

Forward bridge 634 is generally parallelepiped in shape. The height of forward bridge 634 is preferably only a few millimeters, while the bridge length spans beyond the width of a forward portion of the boot to connect to side rails 628. The width of forward bridge 634 is preferably only a few centimeters. A ridge 648 is preferably provided along the center of forward bridge 634 parallel to the longitudinal axis of forward bridge 634. Ridge 648 helps to locate the boot onto toe binding 664. Hook 650 projects upwardly from ridge 648 and is preferably formed of two substantially flat plate-like portions. The first portion projects upwardly and a second portion forms the rearwardly projecting hook portion.

The rearward bridge similarly spans side rails 628. It has a height that is only a few millimeters and a width slightly larger than that of forward bridge 634. As explained in more detail below, a retraction link 644 is provided to open active jaw 602.

Figure 22:
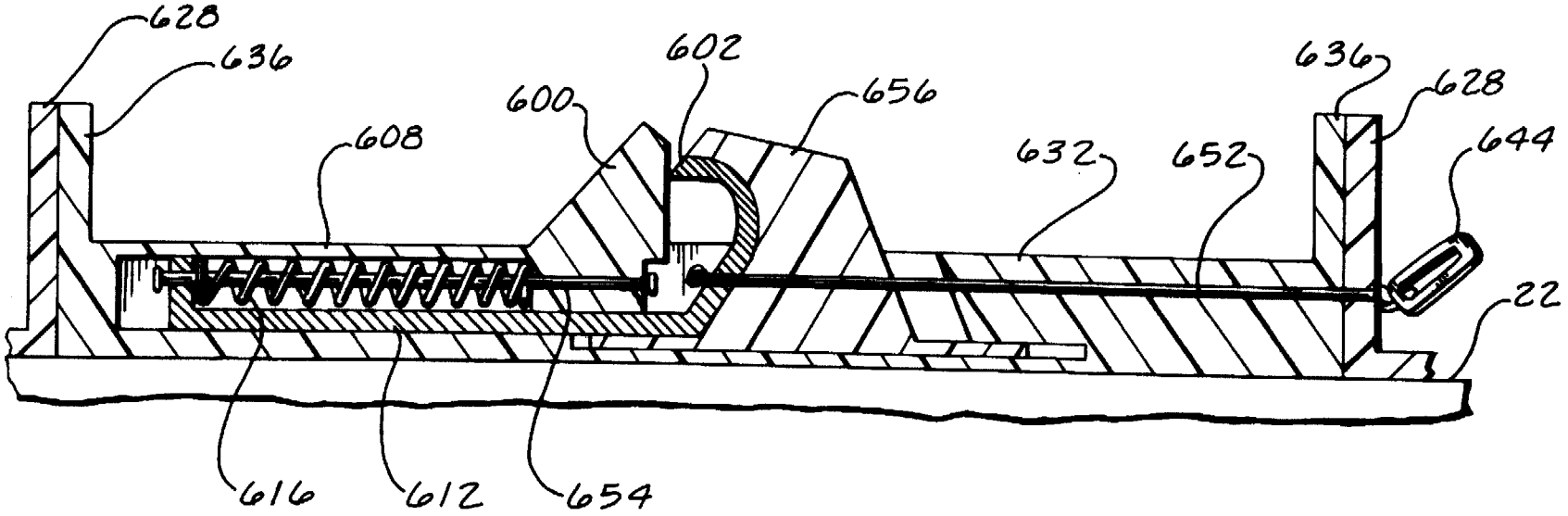
FIG. 22 is a cross-sectional elevational view of the rear coupling mechanism of the binding illustrated in FIG. 21.

FIG. 22 illustrates the details of heel bindings 666. Active jaw 602 includes a jaw sheath 656 having a generally A-shaped configuration on the back side of active jaw 602. Static jaw 600 is similar to that discussed above in conjunction with FIGS. 18 and 19. Active jaw 602 projects upwardly through housing 608 and bends in the direction of static jaw 600 to form an enclosure for securing heel rod 659 discussed below. A slide plate extends from the lower portion of active jaw 602 in a medial direction within housing 608. The end of slide plate 612 projects upwardly to secure a cylindrical, helical spring between the upwardly projecting end of slide plate 612 and housing 608 beneath static jaw 600. A guide rod 654 is provided along the axis of spring 616. Spring 616 is a compression spring that biases active jaw 602 in a closed direction against static jaw 600. Active jaw 602 may be opened by pulling on retraction link 644. Retraction link 644 is pivotally coupled to a retraction arm 652 that extends within housing 608 to link with active jaw 602. Thus, as retraction link 644 is pulled in a lateral direction, spring 616 is compressed and active jaw 602 is separated from static jaw 600 to allow the snowboard boot to be released from heel binding 666. A cord may be attached to retraction link 644 to aid in grasping and pulling retraction arm 652.

Figure 21:
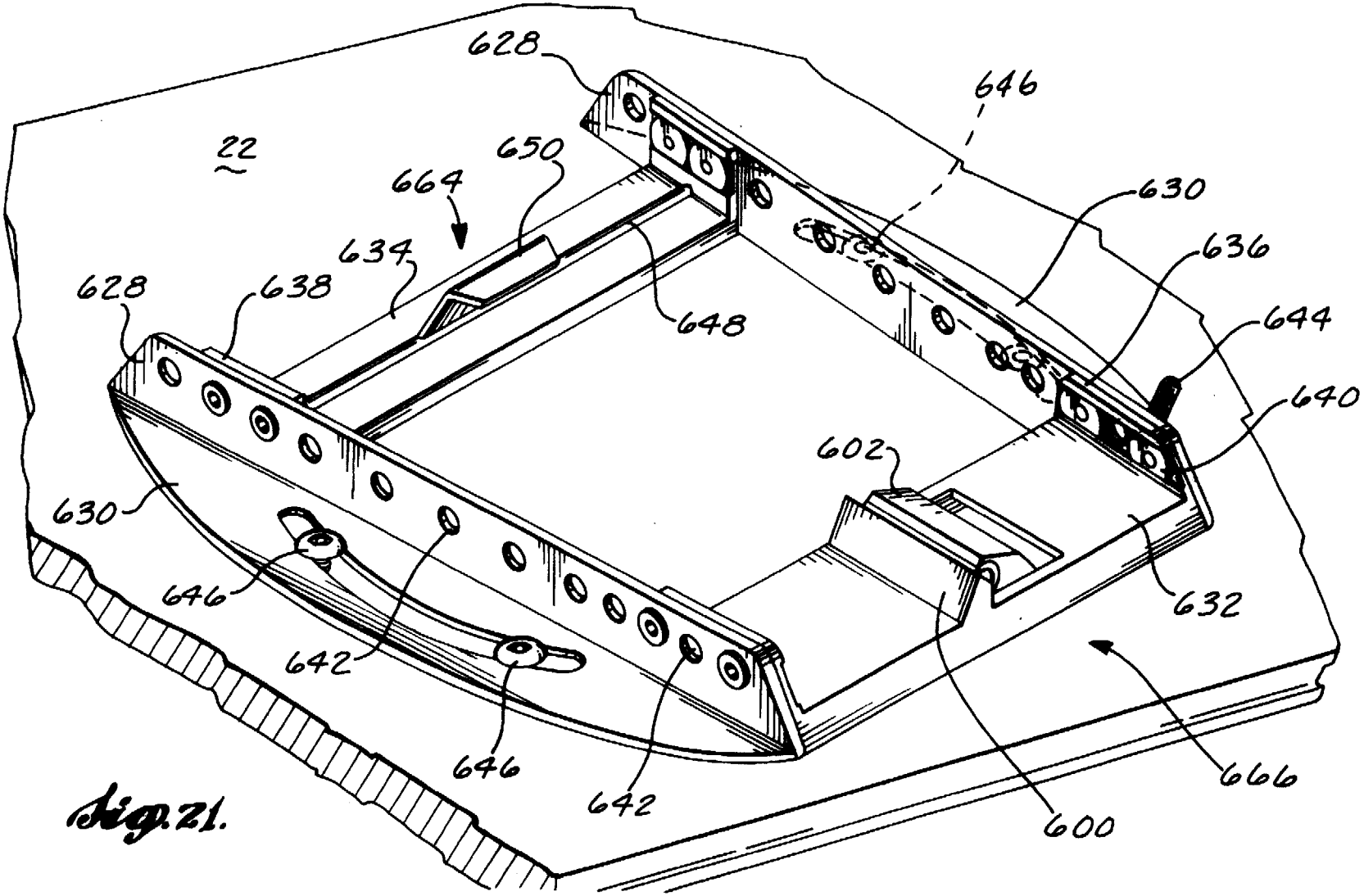
FIG. 21 is a perspective view of another embodiment of a snowboard binding of the present invention illustrating the binding as attached to a snowboard.

It should be understood that, while the binding mechanism shown in FIG. 22 is preferably used with the entire binding illustrated in FIG. 21, any of the above-described binding mechanisms could alternatively be used. Furthermore, alternate arrangements and other binding mechanisms could also be used that hold the heel of the boot in place.

Figure 23:
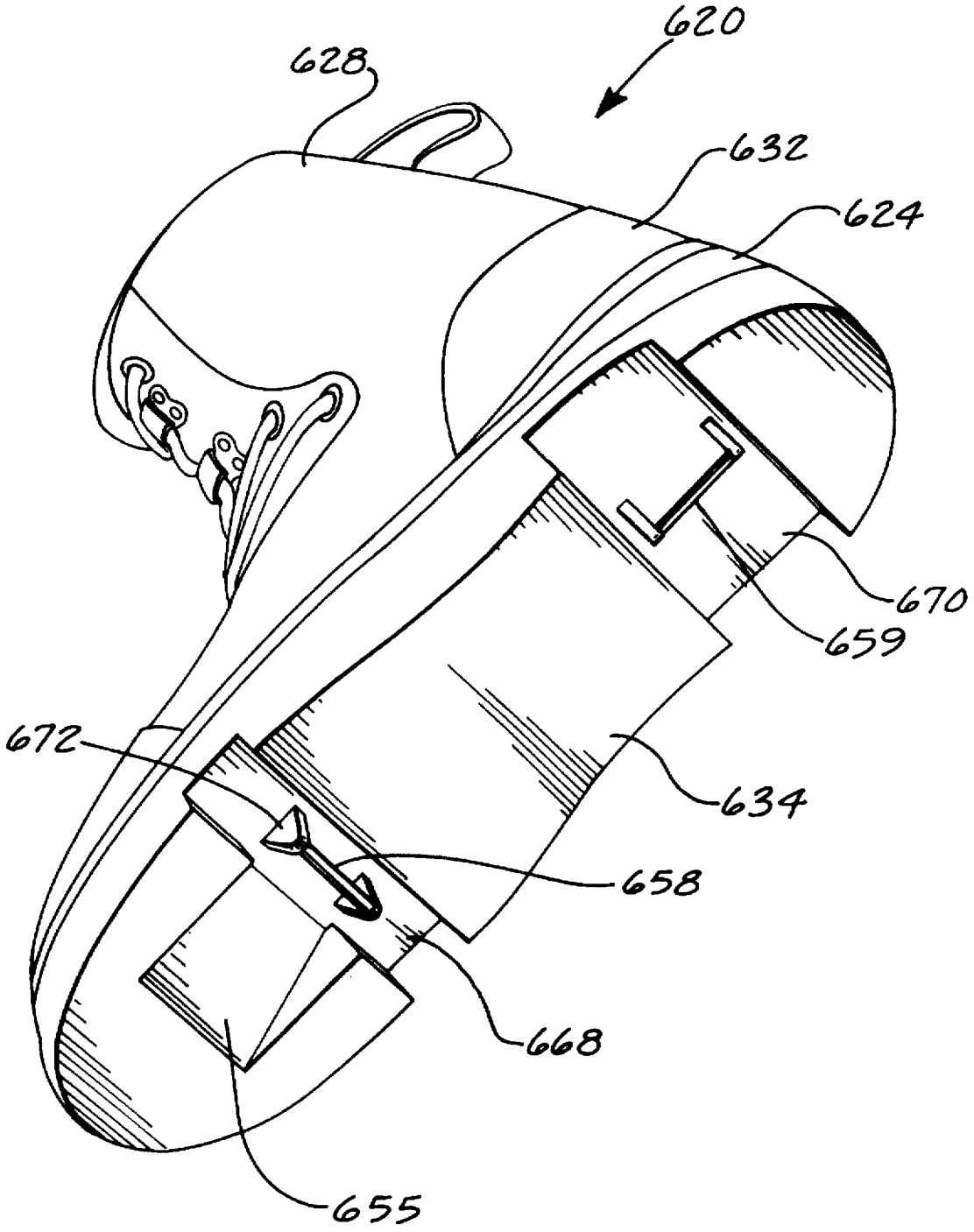
FIG. 23 is a perspective view of the underside of a snowboard boot made for coupling with the binding illustrated in FIG. 21.

The details of boot 720 that are relevant to the above-described binding will now be discussed with reference to FIG. 23. Boot 720 includes an upper 728, a heel counter 732, and a base 724. A tread 734 is attached to base 724 and makes up the sole of boot 720. A rearward recess is provided beneath the heel of boot 720 and is arranged and configured to ride over rearward bridge 632. Thus, rearward recess 770 extends across the heel portion of sole 734. Likewise, a forward recess 768 is provided under a forward portion of the boot corresponding to the ball of the foot. Forward recess 768 also includes a sloped portion 755 that angles up from the bottom of forward recess 768. Sloped portion 755 allows hook 650 to slide within it to be secured to a toe rod 758. Toe rod 758 is secured with rod supports 772 within forward recess 768. Toe rod 758 is preferably oriented transverse to the longitudinal axis of sole 734 such that it can be received by hook 650. Heel rod 759 is secured within rearward recess 770 and is oriented generally parallel to the longitudinal axis of sole 734.

Figure 24:
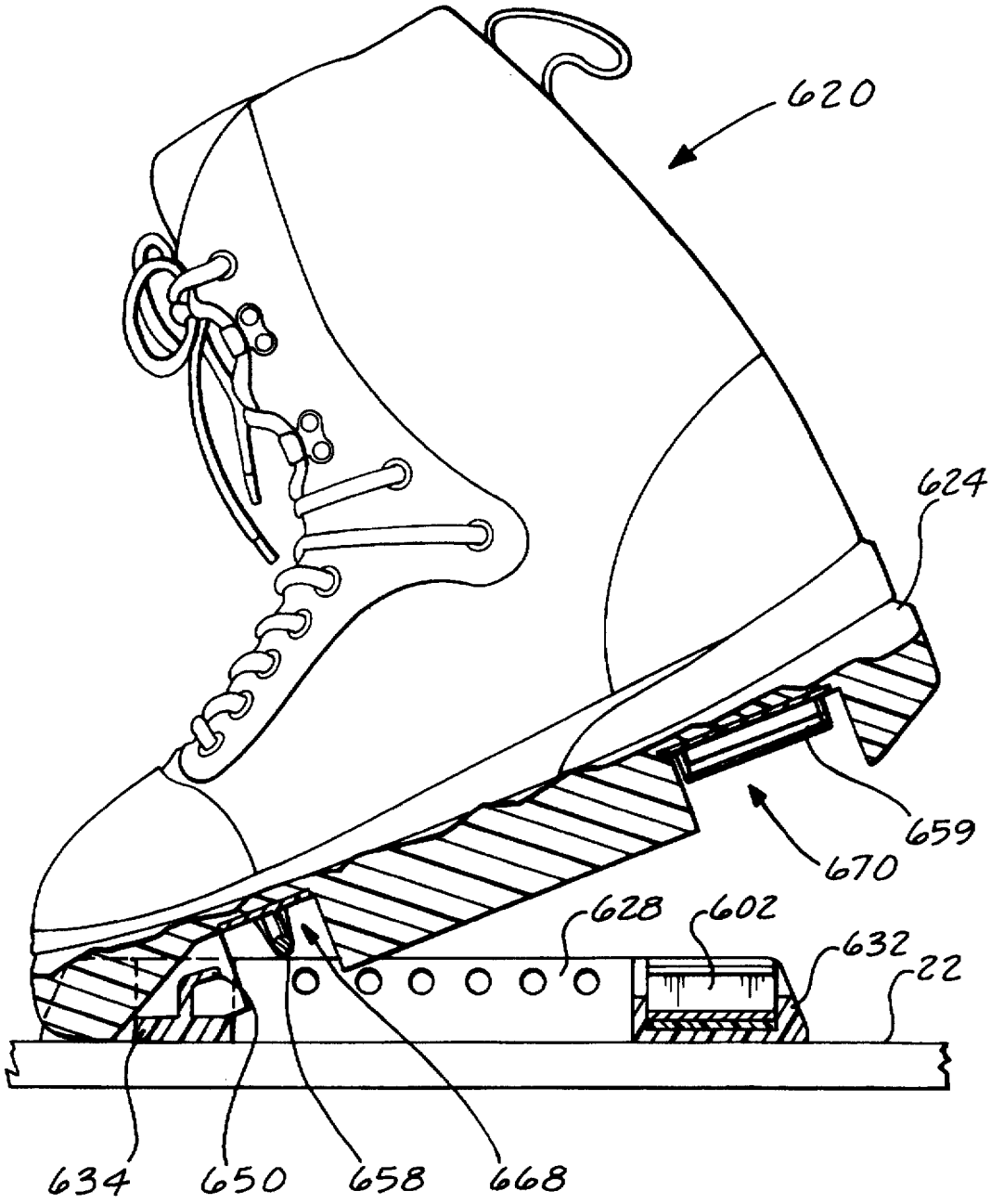
FIG. 24 is a cross-sectional elevational view of the snowboard boot illustrated in FIG. 23 and the snowboard binding illustrated in FIG. 21, showing the boot being positioned for attachment to the binding.
Figure 25:
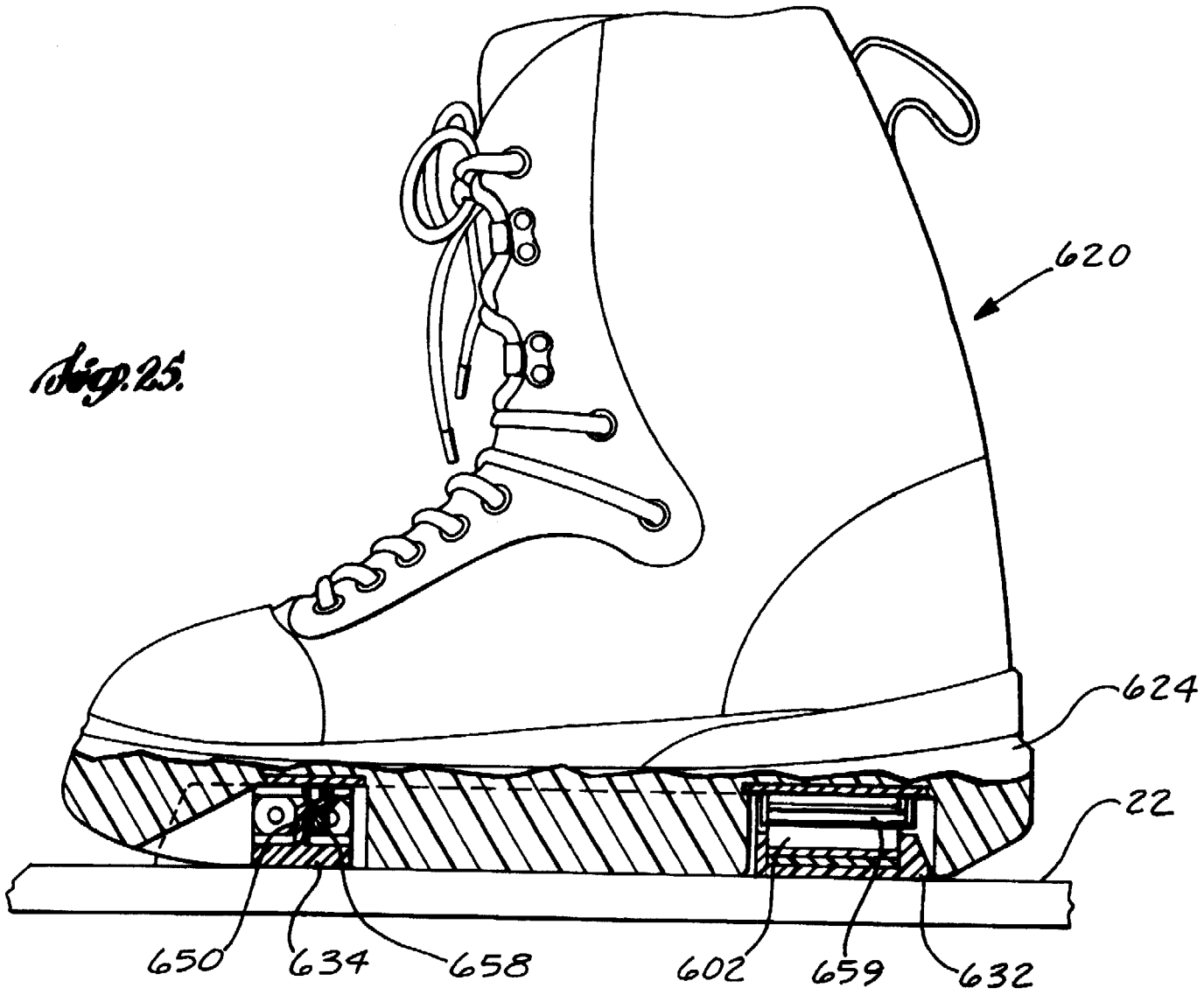
FIG. 25 is a partial cross-sectional elevational view showing the boot and binding of FIG. 24 in a secure position on the snowboard.

FIGS. 24 and 25 illustrate the insertion of boot 720 into the binding. The toe of the boot is placed over hook 650 such that hook 650 is within sloped portion 755. The boot is slid forward to a position where rod 758 is beneath hook 650 and forward bridge 634 is within forward recess 768. In this position, heel red 759 is directly over jaws 600 and 602, and rearward recess 770 is over rearward bridge 632. The heel of the boot is then pressed downwardly to open active jaw 602 and allow rod 759 to be enclosed between active jaw 602 and static jaw 600. Thus, the position illustrated in FIG. 25 is assumed and rearward recess 770 encloses rearward bridge 632. Boot 720 is held in this position until retraction link 644 is pulled, such that active jaw 602 moves away from static jaw 600 to allow the heel of boot 720 to be lifted and the boot to be removed from the binding.

Thus, the binding described with respect to FIGS. 21–25 has several advantages: the entry and exit into the binding are similar to those employed with a ski boot and binding system. However, the binding clasps the boot beneath the sole of the boot such that the toe and heel of the binding can be at or near the edges of the snowboard to accommodate standard snowboard widths. The buckles or straps of boot 720 do not need to be readjusted to secure or release boot 720 from snowboard 22. The binding mechanism may quickly and easily be released or reattached to boot 720 as desired. Hook 650 functioning as toe binding 664 reduces the complication and thus the expense of the binding mechanism and also adds to the simplicity and ease of use of the binding. Lateral and medial compression of tread 734 is still allowed such that desirable movement can be maintained while providing rearward support to the ankle of the user and adequate securement to snowboard 22 for both carved and freestyle turns.

The arrangement of binding mechanisms such that they may be released from the side is also advantageous, since the toe and/or heel of the boot often extends slightly over the side of the board. The binding may be stepped into and simply released.

The embodiments described above provide numerous advantages to snowboarders over snow boots and mountaineering-type boots. Edge control is achieved due to the support structure of boot 20 including highback 26, base 24, and base strap 72, and other straps disclosed that may also be used. The boot also allows the convenience of a step-in binding. The straps do not have to be undone every time the board is taken off one foot or both, since the straps are on the boot itself. The arrangement of the step-in binding can also provide additional lateral flexibility, either in the binding itself or as tread 34 compresses and allows slight pivotal movement of boot 20 about the attachment to bindings 64 and 66.

Thus, edge control and step-in convenience are provided, while not sacrificing comfort and freestyle flexibility. The boot is as easy to walk in as Sorels and has more lateral flexibility for freestyle boarding than a mountaineering-type boot. Depending on which embodiment is used, the lateral flexibility of boot 20 is as great as with a Sorel and a soft binding.

While the preferred embodiments of the invention have been illustrated and described, it will be appreciated that various changes can be made therein without departing from the spirit and scope of the invention. The embodiments shown and described are for illustrative purposes only and are not meant to limit the scope of the invention as defined by the claims.

The embodiments of the invention in which an exclusive property or privilege is claimed are defined as follows:

1. A binding apparatus for securing a boot having a rearward portion and a forward portion to a snowboard having a longitudinal axis, the boot having a forward attachment member beneath the forward portion and a rearward attachment member beneath the rearward portion, the apparatus comprising:

(a) a rigid binding frame for attachment to the snowboard, said frame having a longitudinal axis generally transverse to the longitudinal axis of the snowboard when attached thereto;

(b) a first jaw secured to said frame opposite a first rigid member and substantially along said longitudinal axis of said frame for gasping at least one of the forward attachment member and the rearward attachment member between said first rigid member and said first jaw, said first jaw and said first rigid member defining a receiving portion the receives the at least one attachment member, said first jaw being movably attached to said frame for movement with respect to said frame and said boot, said first jaw disposed substantially along said longitudinal axis such that said first jaw is disposed beneath the boot when engaged with said attachment member, said first jaw extending at least partially over at least a portion of said attachment member when gasped therewith for holding said attachment member from substantial upward movement away from said binding frame;

(c) a second jaw secured to said frame in a location spaced from said first jaw opposite a second rigid member and substantially along said longitudinal axis of said frame and defining a receiving portion for receiving and grasping the other of the forward attachment member and the rearward attachment member between the second rigid member and said second jaw; and (d) a release mechanism coupled to said first jaw for moving at least a portion of said first jaw away from at least one of the forward attachment member and the rearward attachment member to release the boot from between said first jaw and said first rigid member.

2. The binding apparatus of claim 1, wherein said release mechanism is coupled to said second jaw for opening said second jaw to release the boot from said second jaw.

3. The binding apparatus of claim 2, wherein said release mechanism simultaneously moves said first and second jaws away from said first and second rigid members.

4. The binding apparatus of claim 1, wherein said frame includes a binding plate coupled to said first and second jaws, said binding plate having a surface on which at least a portion of the boot rests and wherein said release mechanism is manually operable, said release mechanism including a lever extending to the side of said frame to be positioned adjacent the side of the boot when secured to said jaws, said lever being connected to said first jaw for moving said first jaw away from at least one of the attachment members, said jaws not releasing the attachment members unless said lever is manually moved.

5. The binding apparatus of claim 1, wherein said second jaw is fixed and does not move relative to said frame during release of the boot, the movement of said first jaw allowing both the first and the second attachment members to be released from said first and second jaws.

6. The binding apparatus of claim 1, wherein said release mechanism comprises a slide member attached to said first jaw and a lever pivotally attached to said slide member, movement of said lever causing sliding motion of said slide member and moving said first jaw.

7. The binding apparatus of claim 6, wherein said first rigid member forms a first static jaw secured to said frame adjacent said first jaw near the longitudinal axis of said frame, said first static jaw not moving relative to said frame, said first static jaw and said first jaw forming an opening for receiving at least one of the forward and the rearward attachment members of the boot.

8. A binding apparatus for securing a snowboard boot to a snowboard, the snowboard boot having first and second longitudinally spaced attachment members secured to the bottom of the boot, the apparatus comprising:

(a) a frame member securable to the snowboard, said frame member having a longitudinal axis, said frame member being adapted to be secured to the snowboard with said longitudinal axis positioned at an angle relative to a longitudinal axis of the snowboard;

(b) first and second longitudinally spaced jaws, at least one of said first and second jaws being a movable jaw attached to said frame member generally parallel to said longitudinal axis of said frame member, each jaw being positioned on said frame member opposite an opposing frame structure on said frame, each said opposing frame structure and said opposing jaw forming a receiving portion having an opening into which a respective one of the first and second attachment members is placed and being engageable therewith; and (c) a jaw movement mechanism attached to said frame member and linked by a slide member to said movable jaw, said mechanism including a rigid arm disposed to the side of the frame member so as to extend to the side of the boat when the boot is secured by the jaw, movement of said arm causing said jaw to move relative to said opposing frame structure.

9. The binding apparatus of claim 8, wherein said opposing frame structure is in abutting relationship with said movable jaw when an attachment member is secured thereto.

10. The binding apparatus of claim 9, wherein said opposing frame structure is statically attached to said frame.

11. A snowboard binding apparatus comprising:

(a) a boot defining a longitudinal axis and including a sole, said boot including first and second longitudinally spaced attachment members secured near the longitudinal axis thereof, each of said attachment members projecting downwardly from within a recess formed in said sole and being disposed beneath said sole;

(b) a frame member securable to a snowboard;

(c) first and second jaws, at least one of said jaws being a movable jaw attached to said frame member, each said jaw defining a receiving portion in cooperation with an opposing portion of said frame member and being positioned to receive and engage a respective one of said first and second attachment members of said boot through an opening of said receiving portion when positioned within said recess of said sole of said boot, each said jaw being disposed beneath said sole when engaging said first and second attachment members; and (d) a jaw movement mechanism attached to said frame member and coupled to said movable jaw, said jaw movement mechanism including a release arm extending to the side of said frame member and to the side of the boot when said attachment members are engaged by said first and second jaws.

12. A snowboard binding apparatus comprising:

(a) a boot defining a longitudinal axis and including a sole with a recess therein, said boot including a first attachment member secured near the longitudinal axis thereof, said first attachment member projecting downwardly from within said recess of said sole and being disposed beneath said sole;

a frame securable to a snowboard;

(c) a movable jaw attached to said frame and together with a frame portion defining a receiving portion positioned to engage and receive said first attachment member of said boot within said recess of said sole of said boot, said movable jaw being disposed beneath said sole when engaging said first attachment member; and (d) a jaw movement mechanism attached to said frame and coupled to said movable jaw, said jaw movement mechanism including a release arm extending to the side of said frame and to the side of the boot when said boot is engaged by the movable jaw, wherein said boot sole further comprises flex pads secured alongside of the first attachment member, said flex pads being compressible and resilient to allow the boot to pivot side to side about said first attachment member when engaged by the movable jaw, said flex pads extending lower than said first attachment member.

13. The binding apparatus of claim 12, wherein said flex pads are removable and replaceable, such that flex pads of differing durometers may be used.

14. A snowboard binding apparatus comprising:

(a) a boot defining a longitudinal axis and including a sole with a recess therein, said boot including a first attachment member secured near the longitudinal axis thereof, said first attachment member projecting downwardly from within said recess of said sole and being disposed beneath said sole;

(b) a frame securable to a snowboard;

(c) a movable jaw attached to said frame, said movable jaw forming a receiving portion with said frame that is positioned to engage said first attachment member of said boot within said recess of said sole of said boot, said movable jaw being disposed beneath said sole when engaging said first attachment member; and (d) a jaw movement mechanism attached to said frame and coupled to said movable jaw, said jaw movement mechanism including a release arm extending to the side of said frame and to the side of the boot when said boot is engaged by the movable jaw; and a second attachment member secured to said sole of said boot and a second jaw attached to said frame and forming a receiving portion with said frame that is engageable with and receives said second attachment member, said first attachment member being disposed beneath a generally rearward portion of said boot and said second attachment member disposed beneath a generally forward portion of said boot substantially along said longitudinal axis of said boot, said first and second attachment members projecting downwardly from beneath said sole, and said first and second jaws being disposed beneath said sole when engaged with said first and second attachment member.

15. The binding apparatus of claim 14, wherein said first attachment member comprises a first rod extending generally parallel to the longitudinal axis of said sole of said boot.

16. The binding apparatus of claim 15, wherein said sole of said boot further comprises a rearward recess within which said first rod is held above the lowermost portion of said sole.

17. The binding apparatus of claim 15, wherein said second attachment member comprises a second rod extending generally parallel to the longitudinal axis of said sole of said boot.

18. The binding apparatus of claim 15, wherein said second jaw is fixed relative to said frame.

19. The binding apparatus of claim 18, wherein said second jaw comprises a hook projecting upwardly from said frame, said second attachment member being engageable beneath said hook.

* * * * *

UNITED STATES PATENT AND TRADEMARK OFFICE

CERTIFICATE OF CORRECTION

PATENT NO. : 5,690,350
DATED : November 25, 1997
INVENTOR(S) : B.H. Turner et al.

It is certified that error appears in the above-indentified patent and that said Letters Patent is hereby corrected as shown below:

| COLUMN | LINE | |
|---|---|---|
| | Abstract line 20 of text | "The coupling" should read --The couplings-- |
| 15 (Claim 1, | 29 line 13) | "gasping" should read --grasping-- |
| 15 (Claim 1, | 33 line 17) | "the receives" should read --that receives-- |
| 15 (Claim 1, | 36 line 20) | "jaw disposed" should read --jaw being disposed-- |
| 15 (Claim 1, | 41 line 25) | "gasped" should read --grasped-- |
| 16 (Claim 8, | 47 line 24) | "boat" should read --boot-- |

UNITED STATES PATENT AND TRADEMARK OFFICE

CERTIFICATE OF CORRECTION

PATENT NO. : 5,690,350

DATED : November 25, 1997

INVENTOR(S) : B.H. Turner et al.

It is certified that error appears in the above-indentified patent and that said Letters Patent is hereby corrected as shown below:

| COLUMN | LINE | |
|---|---|---|
| 17 (Claim 12, line 8) | 21 | "a frame securable" should read --(b) a frame securable-- and should be indented to line up vertically under "(a) . . ." |

Signed and Sealed this

Seventeenth Day of March, 1998

*Attest:*

*Attesting Officer*

BRUCE LEHMAN

*Commissioner of Patents and Trademarks*